US010967215B2

(12) United States Patent
Krishnan et al.

(10) Patent No.: US 10,967,215 B2
(45) **Date of Patent: *Apr. 6, 2021**

(54) RESISTIVE DEVICE EMPLOYING EDDY CURRENT BRAKING

(71) Applicant: THE REGENTS OF THE UNIVERSITY OF MICHIGAN, Ann Arbor, MI (US)

(72) Inventors: Chandramouli Krishnan, Ann Arbor, MI (US); Edward Peter Washabaugh, IV, Ann Arbor, MI (US); Richard Brent Gillespie, Ann Arbor, MI (US); Stephanie Goretski, Escondido, CA (US); Sara Abdulhamid, Farmington Hills, MI (US); Elizabeth Mays, Ann Arbor, MI (US)

(73) Assignee: THE REGENTS OF THE UNIVERSITY OF MICHIGAN, Ann Arbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/666,671

(22) Filed: Oct. 29, 2019

(65) Prior Publication Data

US 2020/0061404 A1 Feb. 27, 2020

Related U.S. Application Data

(63) Continuation of application No. 15/880,756, filed on Jan. 26, 2018, now Pat. No. 10,507,351.

(Continued)

(51) Int. Cl.
*A63B 21/005* (2006.01)
*A63B 21/00* (2006.01)

(Continued)

(52) U.S. Cl.
CPC ..... *A63B 21/0052* (2013.01); *A63B 21/4011* (2015.10); *A63B 21/4017* (2015.10);

(Continued)

(58) Field of Classification Search
CPC ..... A63B 21/0052; A63B 21/4025; A63B 21/4047; A63B 21/4011; A63B 23/0464;

(Continued)

(56) References Cited

U.S. PATENT DOCUMENTS 5,788,618 A * 8/1998 Joutras ..... A43B 1/0054 482/114
5,954,621 A * 9/1999 Joutras ..... A43B 1/0054 482/114

(Continued)

OTHER PUBLICATIONS

Gosline & Hayward, "Eddy Current Brakes for Haptic Interfaces: Design, Identification, and Control," IEEE/ASME Transactions on Mechatronics, vol. 13, Dec. 2008, pp. 669-677.

(Continued)

*Primary Examiner* — Garrett K Atkinson
(74) *Attorney, Agent, or Firm* — Harness, Dickey & Pierce, P.L.C.

(57) ABSTRACT

A resistive device that enables adjustable resistance in at least one direction using an attachment system and associated eddy current braking system. The resistive device can be bench-mounted, in some embodiments, used for physical therapy caused by neuromuscular diseases, such as stroke and cerebral palsy, orthopedic disorders, general disuse, or even for overall fitness.

17 Claims, 22 Drawing Sheets

Related U.S. Application Data

(60) Provisional application No. 62/450,600, filed on Jan. 26, 2017.

(51) Int. Cl.
*A63B 23/04* (2006.01)
*A63B 23/12* (2006.01)

(52) U.S. Cl.
CPC ..... *A63B 21/4025* (2015.10); *A63B 21/4047* (2015.10); *A63B 23/0464* (2013.01); *A63B 23/1281* (2013.01); *A61H 2201/1207* (2013.01); *A61H 2201/165* (2013.01)

(58) Field of Classification Search
CPC ..... A63B 23/1281; A63B 21/4017; A61H 2201/165; A61H 2201/1207
See application file for complete search history.

(56) References Cited

U.S. PATENT DOCUMENTS 5,976,063 A * 11/1999 Joutras ..... A43B 1/0054 482/114
5,980,435 A * 11/1999 Joutras ..... A43B 1/0054 482/114
7,150,721 B2 12/2006 Houser
7,445,606 B2 * 11/2008 Rastegar ..... A61H 3/00 601/23
7,507,215 B2 3/2009 Ryan
7,645,246 B2 * 1/2010 Rastegar ..... A63B 21/0055 601/5
7,695,415 B2 * 4/2010 Goel ..... A63B 69/36 482/136
7,775,898 B1 * 8/2010 Allen ..... A63B 69/0059 473/214
7,935,029 B2 * 5/2011 Hector ..... A63B 69/12 482/55
8,062,237 B2 * 11/2011 Rastegar ..... A61H 3/00 601/5
8,142,370 B2 * 3/2012 Weinberg ..... F16F 9/532 601/5
8,235,869 B2 * 8/2012 Rastegar ..... A63B 21/055 482/2
8,419,804 B2 * 4/2013 Herr ..... A61F 2/60 623/24
8,900,325 B2 * 12/2014 Herr ..... A61F 2/72 623/24
8,939,924 B1 * 1/2015 Paulos ..... A61F 5/01 602/16
9,211,201 B2 * 12/2015 Herr ..... A61H 3/00
9,345,592 B2 * 5/2016 Herr ..... B25J 9/0006
9,351,856 B2 * 5/2016 Herr ..... H02K 7/06
9,522,076 B1 * 12/2016 Paulos ..... A61F 5/0585
9,526,635 B2 * 12/2016 Gilbert ..... A61F 2/605
9,554,922 B2 * 1/2017 Casler ..... A61F 2/68
9,652,037 B2 * 5/2017 Rubin ..... A63F 13/24
9,904,358 B2 * 2/2018 Rubin ..... G06F 3/011
10,070,974 B2 * 9/2018 Herr ..... G01L 5/0028
10,105,244 B2 * 10/2018 Herr ..... A61F 2/68
10,213,323 B2 * 2/2019 Casler, Jr. ..... A61F 2/72
10,222,859 B2 * 3/2019 Rubin ..... G06F 3/013
2006/0046907 A1 * 3/2006 Rastegar ..... A63B 21/00178 482/91
2006/0046908 A1 * 3/2006 Rastegar ..... A63B 21/0054 482/91
2006/0046910 A1 * 3/2006 Rastegar ..... A63B 21/002 482/91
2007/0037663 A1 * 2/2007 Goel ..... A63B 23/0211 482/1
2008/0108917 A1 * 5/2008 Joutras ..... A61H 1/024 601/34
2008/0108918 A1 * 5/2008 Joutras ..... A61H 1/0277 601/34
2008/0277943 A1 11/2008 Donelan et al.
2009/0192619 A1 7/2009 Martin et al.
2010/0113980 A1 * 5/2010 Herr ..... A61F 2/72 600/587
2010/0160121 A1 * 6/2010 Rastegar ..... A63B 21/0055 482/91
2010/0160122 A1 * 6/2010 Rastegar ..... A63B 21/4025 482/91
2010/0174384 A1 * 7/2010 Herr ..... A61F 2/6607 623/32
2010/0174385 A1 * 7/2010 Casler ..... B25J 9/0006 623/50
2010/0179668 A1 * 7/2010 Herr ..... A61F 2/6607 623/51
2010/0197467 A1 * 8/2010 Hector ..... A63B 69/12 482/55
2010/0216602 A1 * 8/2010 Goel ..... A63B 23/0233 482/8
2013/0312483 A1 * 11/2013 Herr ..... A61F 2/6607 73/1.38
2014/0081421 A1 * 3/2014 Herr ..... A61F 2/68 623/25
2014/0081424 A1 * 3/2014 Herr ..... B25J 9/0006 623/50
2014/0094721 A1 * 4/2014 Diallo ..... A63B 21/0058 601/5
2014/0274600 A1 * 9/2014 Dalebout ..... A63B 21/0051 482/115
2015/0173929 A1 * 6/2015 Kazerooni ..... A61H 1/00 602/16
2016/0139666 A1 * 5/2016 Rubin ..... G09B 9/00 345/633
2016/0235557 A1 * 8/2016 Herr ..... G01L 5/0028
2016/0296348 A1 * 10/2016 Herr ..... A61H 3/00
2017/0083085 A1 * 3/2017 Rubin ..... A63F 13/24
2017/0086991 A1 * 3/2017 Casler ..... G01P 21/00
2017/0106222 A1 * 4/2017 Mayer ..... A63B 22/0605
2017/0242477 A1 * 8/2017 Rubin ..... G06T 19/006
2017/0367852 A1 * 12/2017 Kazerooni ..... A61F 2/68
2018/0214730 A1 * 8/2018 Larose ..... A63B 21/00845
2019/0116896 A1 * 4/2019 Armour ..... A61N 1/0452
2019/0117415 A1 * 4/2019 Herr ..... A61F 2/6607

OTHER PUBLICATIONS

Washabaugh et. al., "A Novel Application of Eddy Current Braking for Functional Strength Training During Gait," Annals of Biomedical Engineering, vol. 44, Sep. 9, 2016, pp. 2760-2773.

* cited by examiner

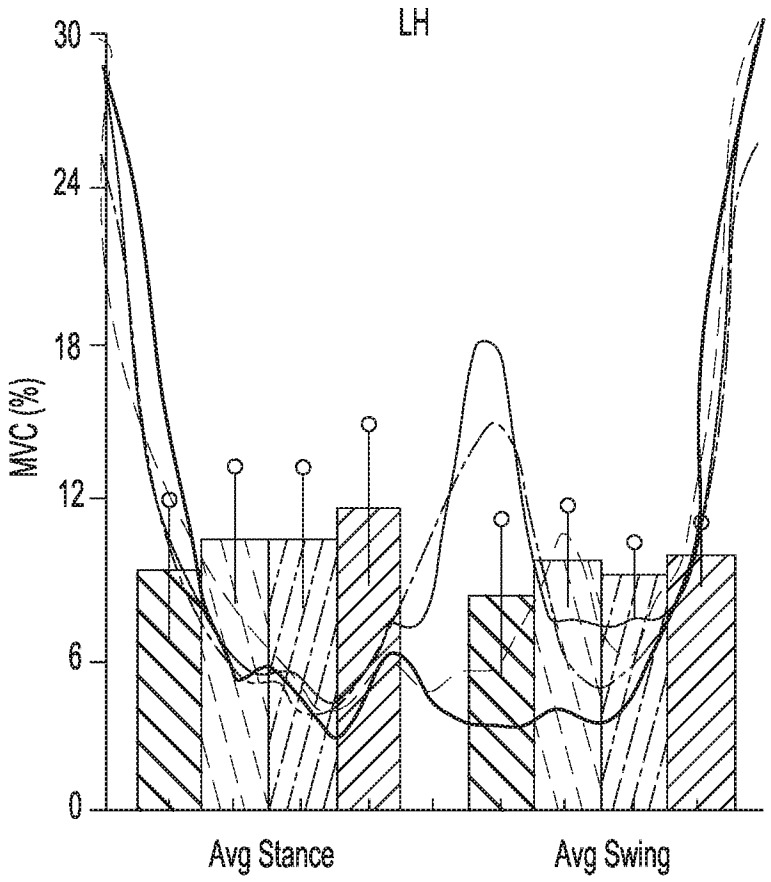
Fig-6D
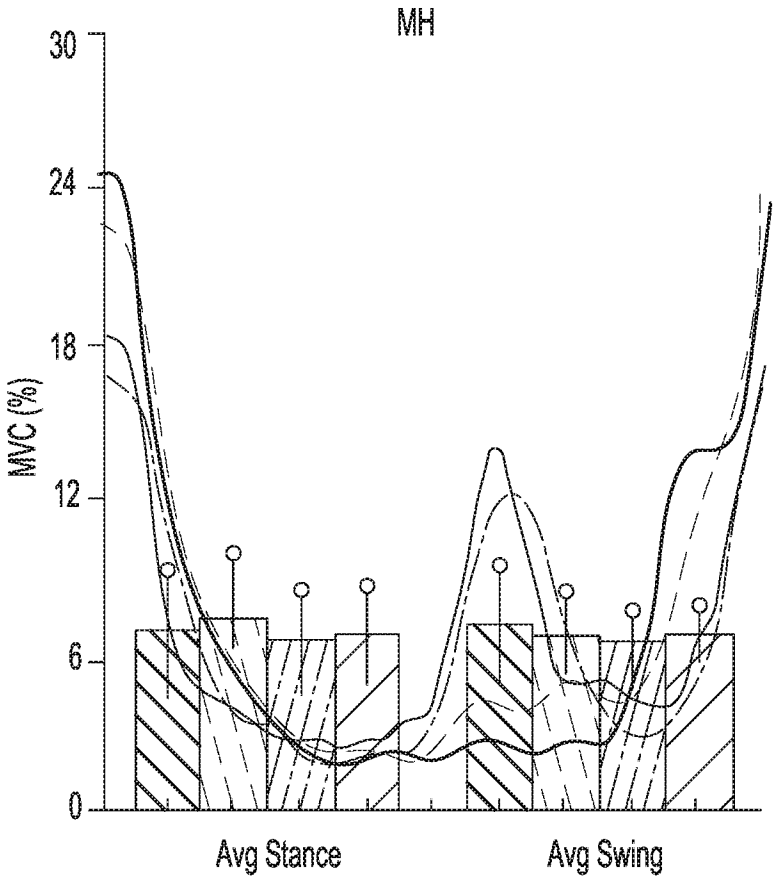
Fig-6C
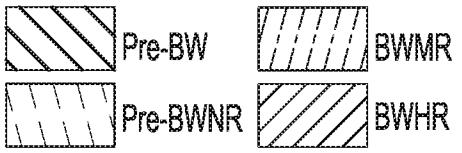

Top View
Side View
Front
1 Pair of Magnets
50
46'
46'
46'
46'
46'

2 Pairs of Magnets
50
46"
46"
46"
46"
46"
46"
46"
46"
46"
46"
or
or
50
46"
46"

Key:
Magnet
North Pole
South Pole
Ferromagnetic Backarm
Material Could be Non-Ferrous

RESISTIVE DEVICE EMPLOYING EDDY CURRENT BRAKING

CROSS-REFERENCE TO RELATED APPLICATIONS

This application is a continuation of U.S. patent application Ser. No. 15/880,756, filed on Jan. 26, 2018, which claims the benefit of U.S. Provisional Application No. 62/450,600, filed on Jan. 26, 2017. The entire disclosures of the above applications are incorporated herein by reference.

FIELD

The present disclosure relates to resistive devices and, more particularly, to resistive devices that employ eddy current braking.

BACKGROUND AND SUMMARY

This section provides background information related to the present disclosure which is not necessarily prior art. This section provides a general summary of the disclosure, and is not a comprehensive disclosure of its full scope or all of its features.

Many patients with stroke, cerebral palsy, and other neurological conditions have significant limitations in walking, and experience limited mobility for the rest of their life. Lack of mobility significantly affects functional independence and, consequently, results in greater physical disability. Facilitating gait recovery, therefore, is a key goal in rehabilitation.

With the growing elderly population, the prevalence of many of the neurological conditions is expected to increase worldwide, and the need for intervention to address gait dysfunction will grow. Appropriately designed rehabilitation devices can assist in meeting this imminent heightened demand for care.

Task-specific training is recognized as the preferred method for gait training following neurological injury because the motor activity seen in this type of rehabilitation is known to facilitate neural plasticity and functional recovery. However, current task-oriented gait training approaches seldom focus on improving muscle strength and impairment, which are also critical for motor recovery and plasticity.

For example, incorporating strengthening exercises into rehabilitation interventions can counteract muscle weakness and improve function in individuals with a wide variety of neurological and orthopedic disorders. Numerous studies have also demonstrated a link between the ability to produce adequate force in the muscles of lower limbs and gait speed following neurological injury. Additionally, resistance training may result in adaptive changes in the central nervous system.

However, the benefits of strength training may not translate maximally into improvements in gait function unless the training incorporates task-specific elements. This task-specific loading of the limbs—termed as functional strength training—is gaining popularity when rehabilitating individuals with neurological injury.

Currently, devices exist to provide functional strength training during walking. The simplest of which applies resistance by placing a weight on the lower limb. Research indicates that this intervention can increase the metabolic rate of healthy subjects as well as increase power of the hip and knee and muscle activation during walking in neurologically injured populations. While this method of functional strength training is simple and practicable, it is hindered by a low torque-to-weight ratio: making large resistances unobtainable without excessively large weights.

Cable driven devices address this issue by locating the heavy force generating elements (actuators and cable spools) away from the patient. This device resists ankle translation during the swing phase of gait, and studies have found that it can potentially improve step length symmetry and gait speed following stroke. However, methods that resist the user through cables will be difficult to use in over-ground training.

The majority of the existing methods for functional strength training apply resistance to the end effector region of the leg (i.e., foot or ankle). Because of this, the resistance may be irregularly distributed between the hip and knee joints, and compensatory strategies could be promoted as weaker muscles are not specifically targeted in the training. The magnitude of resistance applied to the leg could also change as a function of limb position. Further, the resistance in these applications is usually unidirectional, which would assist movement during certain phases of gait. Bidirectional resistance is possible, but only obtainable with supplementary equipment (additional actuators and cables) and controls that utilize gait detection.

For these reasons, providing resistance in the joint space (i.e., across the joint) may be beneficial for training and other biomechanical evaluations. However, making a device that is lightweight and wearable while still providing high bidirectional torque requires a unique approach.

According to the principles of the present teachings, a resistive device is provided that enables adjustable resistance to the muscles used during walking for functional strength training of gait, for example. Because the resistive device of the present teachings can be bench mounted, it strengthens the muscles used in this task. As outlined herein, this method of therapy is called functional strength or resistance training. The specific muscles are dependent on the joints (hip, knee, or both) that the resistive device is being worn on. The resistive device can be used for physical therapy made necessary due to weakness caused by neuromuscular diseases, such as stroke and cerebral palsy, orthopedic disorders, general disuse, or even for overall fitness.

Conventional resistive training strengthens isolated muscle groups during either flexion or extension, but does not have neuroplastic advantages. Purely assistive devices are advantageous because encourage goal-directed repetitive motions and facilitate neuroplasticity due to motor learning, but increases in patient strength are minimally seen in such assistive devices.

The present teachings integrate both concepts in that they provide either unidirectional or bidirectional resistance to motions of the leg during walking or other appendage movement, providing an option for in home use by patients, fewer hours spent in clinic for therapy, and better patient outcomes. There are a few existing devices designed for functional strength training, but they fail to address many key aspects of the therapy.

The forces that resist motion are purely dissipative and no energy is stored to assist the other motions of the leg as would be the case with a weight, spring, or entirely treadmill-based approach. In some embodiments of the present teachings, the present teachings can be used in conjunction with a treadmill or other machine, but does not require the use of one. Conventional devices require a treadmill and the nature of the design causes the wearable resistive device to be assistive during certain stages of walking as the treadmill shares in the work. The present invention addresses the most important aspects of functional strength training.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1A is a diagram showing the basis of force generation during eddy current braking. As the disc rotates through a magnetic field (B) with angular velocity (ω), eddy currents (I) form within the disc. In accordance with Lorentz force equation and the right hand rule, the resulting force always opposes the angular velocity.

Figure 4A:
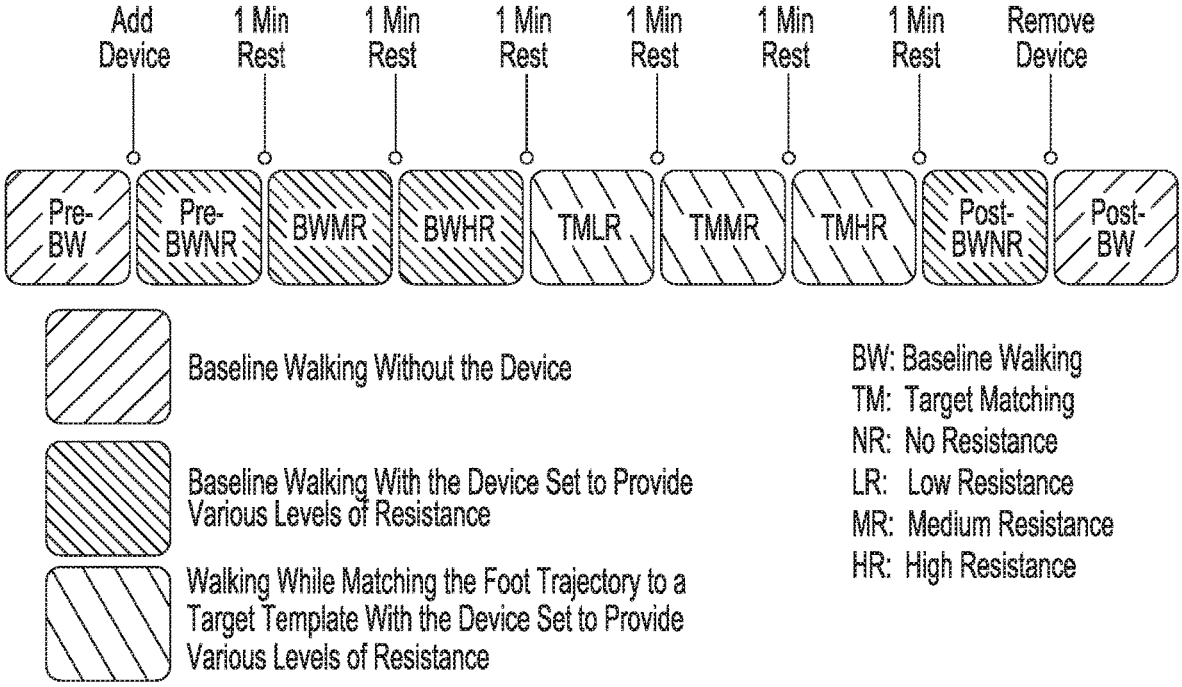
FIG. 4A is a schematic of the experimental protocol used for testing an embodiment of the wearable resistive device.
Figure 4B:
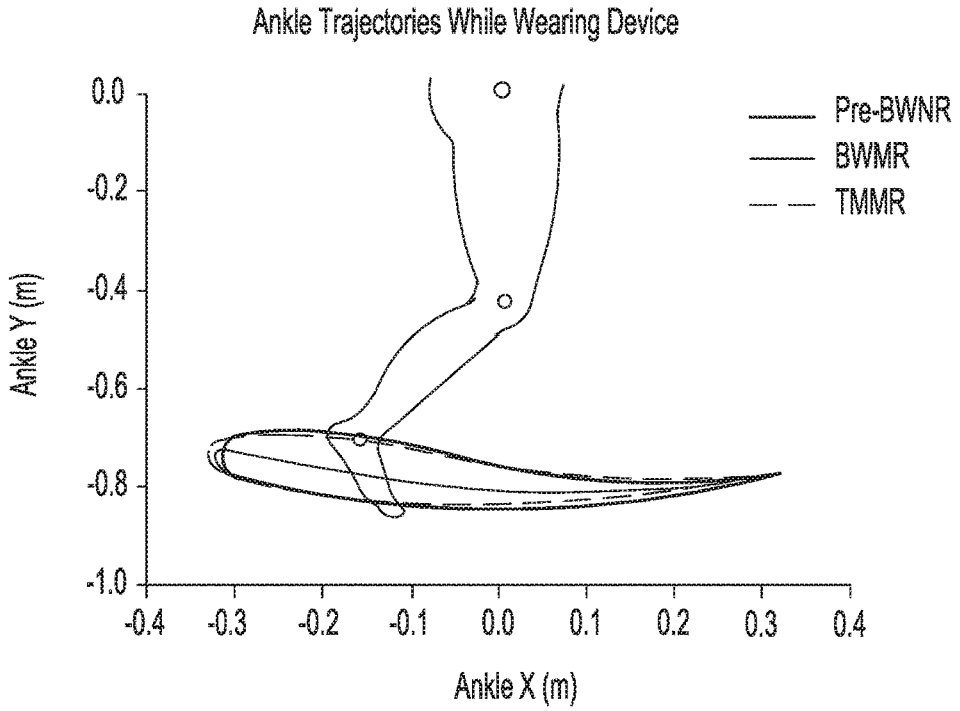

FIG. 4B is a sample of ankle trajectories from a participant while walking on the treadmill under different loading conditions. The trajectories are x-y position of the lateral malleolus with respect to the greater trochanter of the hip in the sagittal plane. Ankle trajectories were computed using a forward-kinematic model that used hip and knee joint angles and the segment lengths of the thigh and shank. Some embodiments of the wearable resistive device can use data such as these to provide training feedback as a means to better engage the user in training. The leg's position on the plot corresponds to the mid-swing phase of gait. The pre-BWNR refers to baseline walking with no resistance condition prior to the target matching conditions. The BWMR refers to baseline walking with medium resistance condition. Here, the height of the ankle trajectory (i.e., Ankle Y) was observed to reduce due to torque exerted by the wearable resistive device. The TMMR refers to target matching with medium resistance condition. During target matching, the participant viewed their pre-BWNR trajectory on the monitor and attempted to match their foot trajectory with the target. The TMMR trajectory was very similar to that of pre-BWNR, indicating the participant was able to match the target without any difficulty. Note that for clarity purposes, only three conditions are shown in the figure.

Figure 5A:
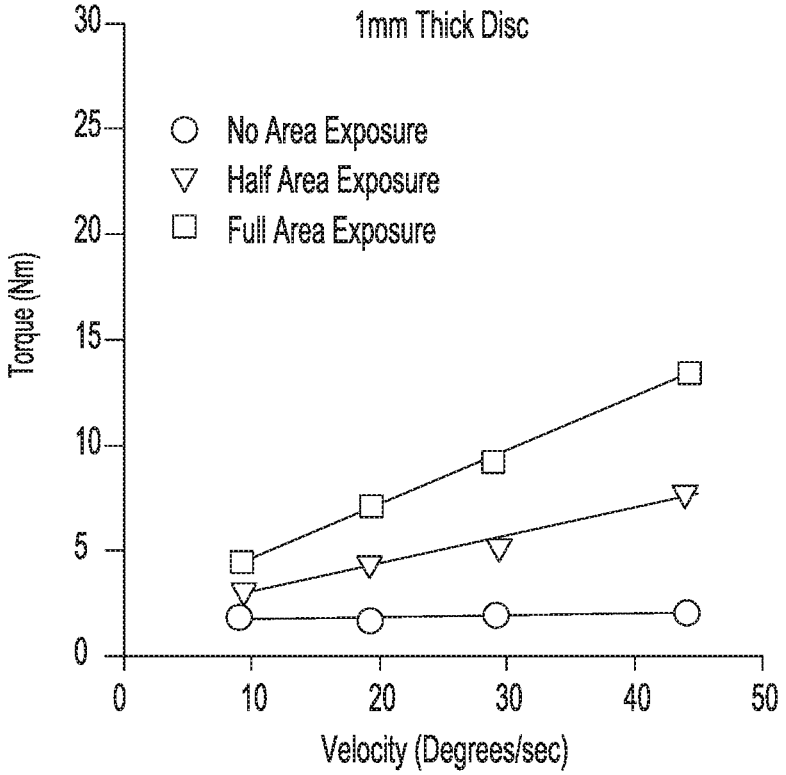
Figure 5B:
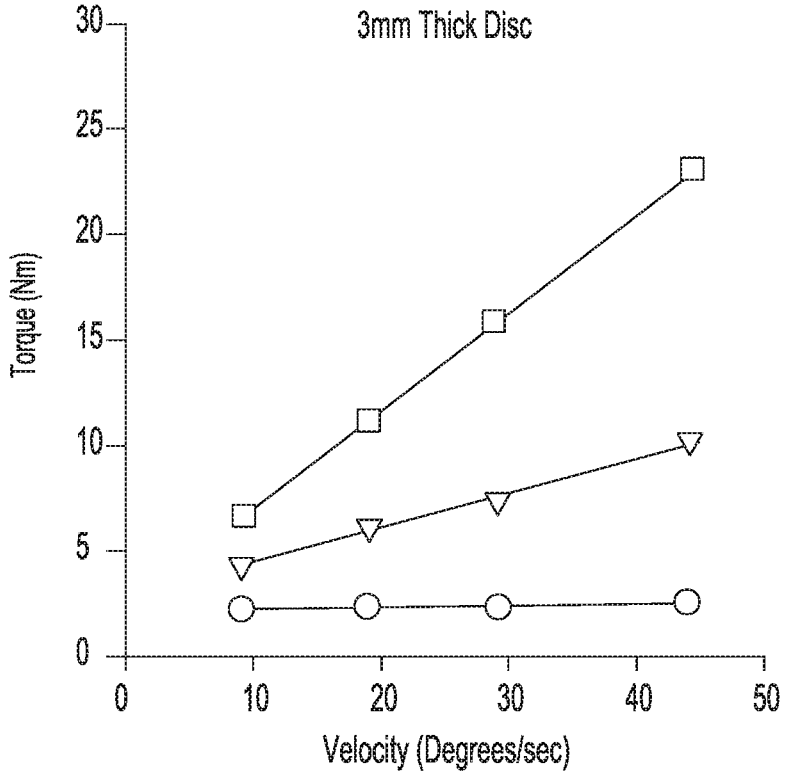
Figure 5C:
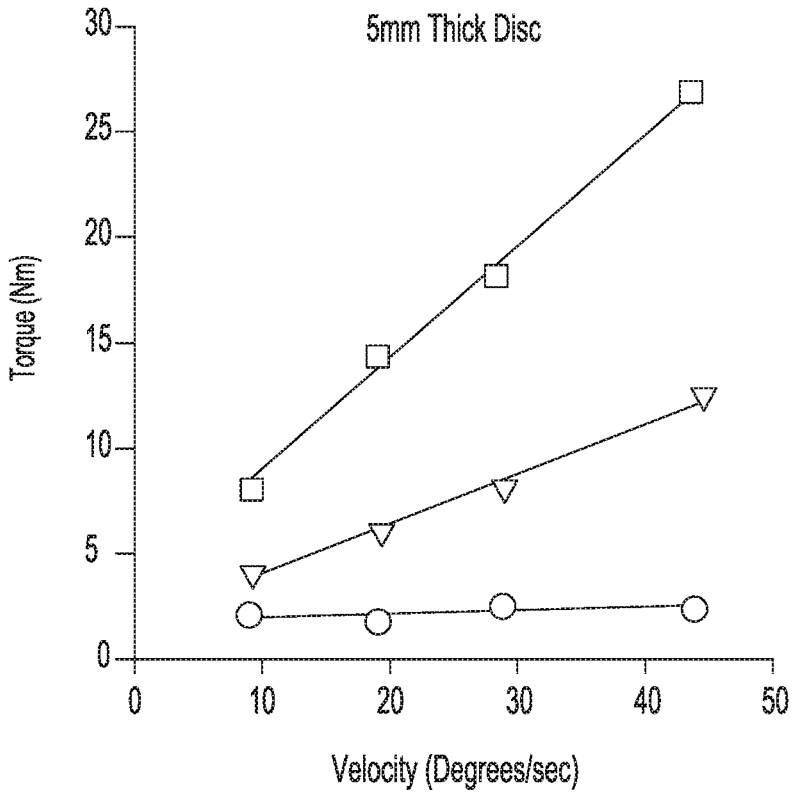
Figures 6A, 6B:
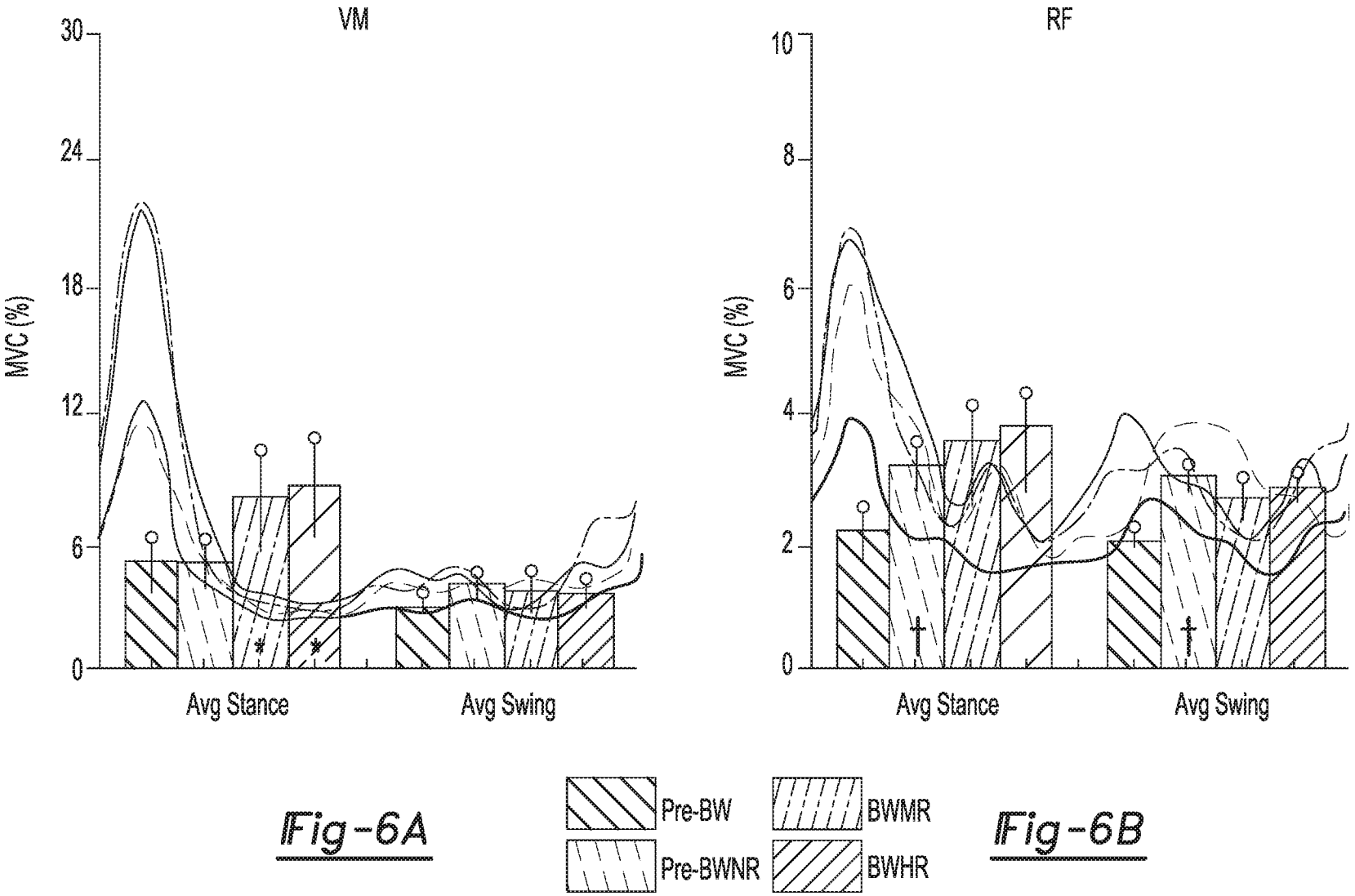
Figure 6F:
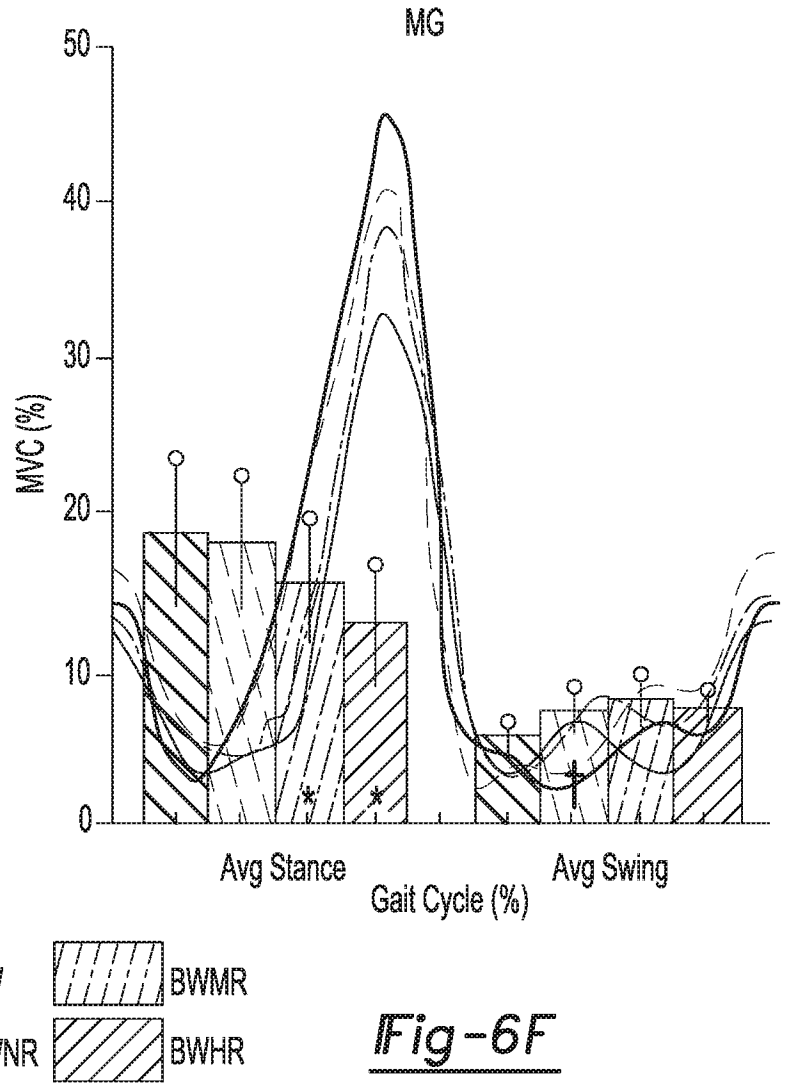
Figure 6E:
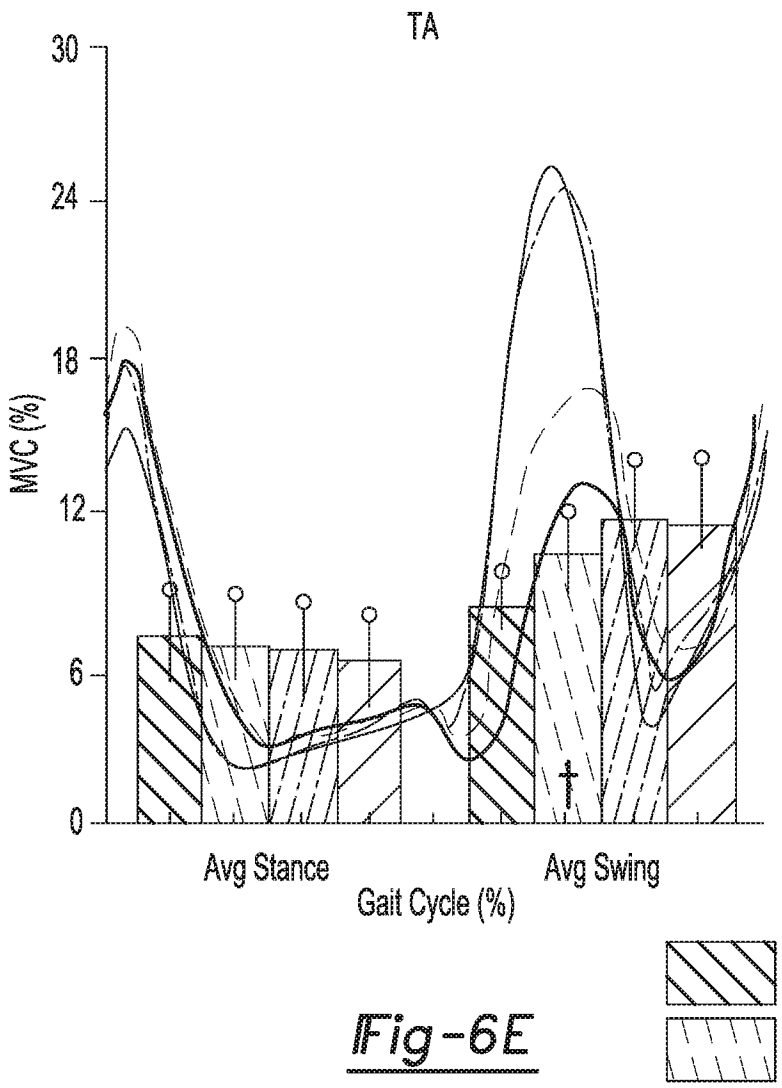
Figure 6H:
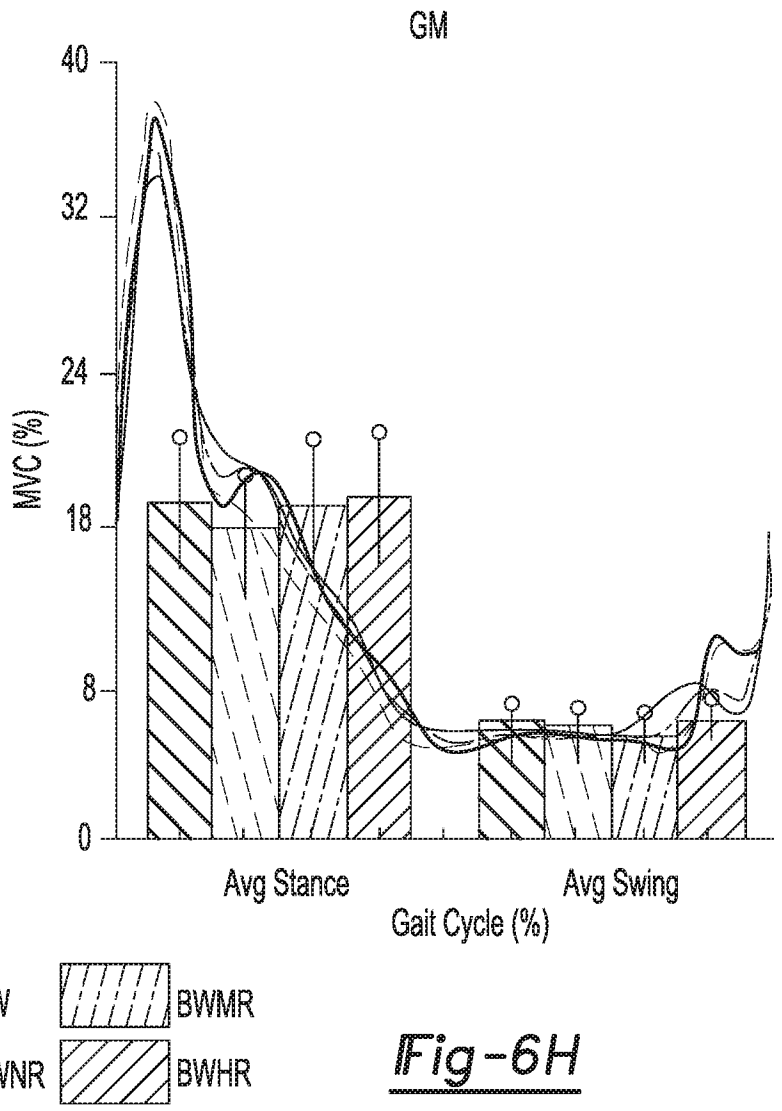
Figure 6G:
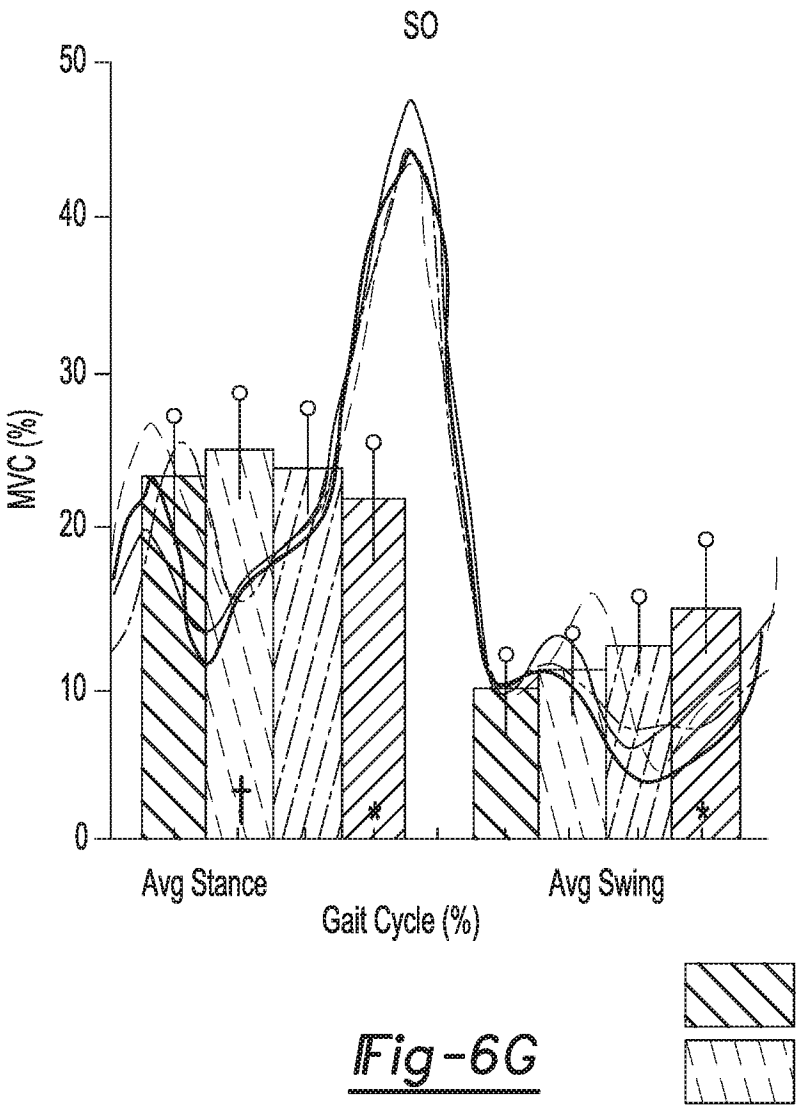

FIGS. 5A-5C are plots showing the results of benchtop testing performed on a Biodex isokinetic dynamometer with the eddy current braking device. The torques generated at various velocities were evaluated for three different discs (1 mm, 3 mm, and 5 mm) at three different exposure levels (no exposure, half exposure, and full exposure). At these velocities, the resistive torque scaled linearly with the velocity of the disc. The resistive torque was also proportional to the area of magnetic field exposed to the disc. The thickness of the disc also scaled the torque; however, torque appeared to plateau after 3 mm of disc thickness.

FIGS. 6A-6H shows the average electromyographic activity while wearing an embodiment of the device on the knee while walking without receiving feedback through the device. Traces show the mean ensemble averaged activation profiles (across all participants) during each walking condition, while bars show the average activation during the stance and swing phase of each condition. Note that muscle activation increased for many of the muscles tested. Error bars show the standard error of the mean. Daggers indicate significant differences between pre-baseline walking (pre-BW) and pre-baseline walking with no resistance (pre-BWNR) trials, and asterisks indicate significance in comparison with the pre-baseline walking with no resistance (pre-BWNR) trial. BW: baseline walking; BWNR: baseline walking with no resistance; BWMR: baseline walking with medium resistance; BWHR: baseline walking with high resistance; VM: vastus medialis; RF: rectus femoris; MH: medial hamstring; LH: lateral hamstring; TA: tibialis anterior; MG: medial gastrocnemius; SO: soleus; GM: gluteus medius.

FIGS. 7A-7D shows the hip and knee joint angles while walking while wearing an embodiment of the wearable resistive device on the knee. Traces show the average kinematic profiles for the joints over a single stride. Pre-BW depicts walking without the device, while Pre-BWNR depicts walking while wearing the device set with the brake to provide no resistance. Comparison of these two traces reveals transparency of the brake when no resistance is provided. BWMR and BWMR traces depict the kinematic profiles while walking under medium and high resistances without feedback given through the device. TMLR, TMMR, and TMHR traces depict the kinematic profiles while walking under low, medium, and high resistances while given feedback. Alternatively, the feedback could be increased or reduced as another means to increase training intensity while using the device.

FIGS. 8A-8H shows the average electromyographic activity muscles while wearing an embodiment of the device on the knee while walking and receiving feedback through the device. The muscle activation is significantly increased in the VM, RF, MH, LH, TA, SO, MG, and GM muscles when a resistance was added to the device compared with when the brake was set to provide no resistance. Traces show the mean ensemble averaged activation profiles (across all participants) during each walking condition, while bars show the average activation during the stance and swing phase of each condition. Error bars show the standard error of the mean. Daggers indicate significant differences between pre=baseline walking (pre-BW) and pre-baseline walking with no resistance (pre-BWNR) trials, and asterisks indicate significance in comparison with the pre-baseline walking with no resistance (pre-BWNR) trial. BW: baseline walking; BWNR: baseline walking with no resistance; BWMR: baseline walking with medium resistance; BWHR: baseline walking with high resistance; VM: vastus medialis; RF: rectus femoris; MH: medial hamstring; LH: lateral hamstring; TA: tibialis anterior; MG: medial gastrocnemius; SO: soleus; GM: gluteus medius.

Figure 9A:
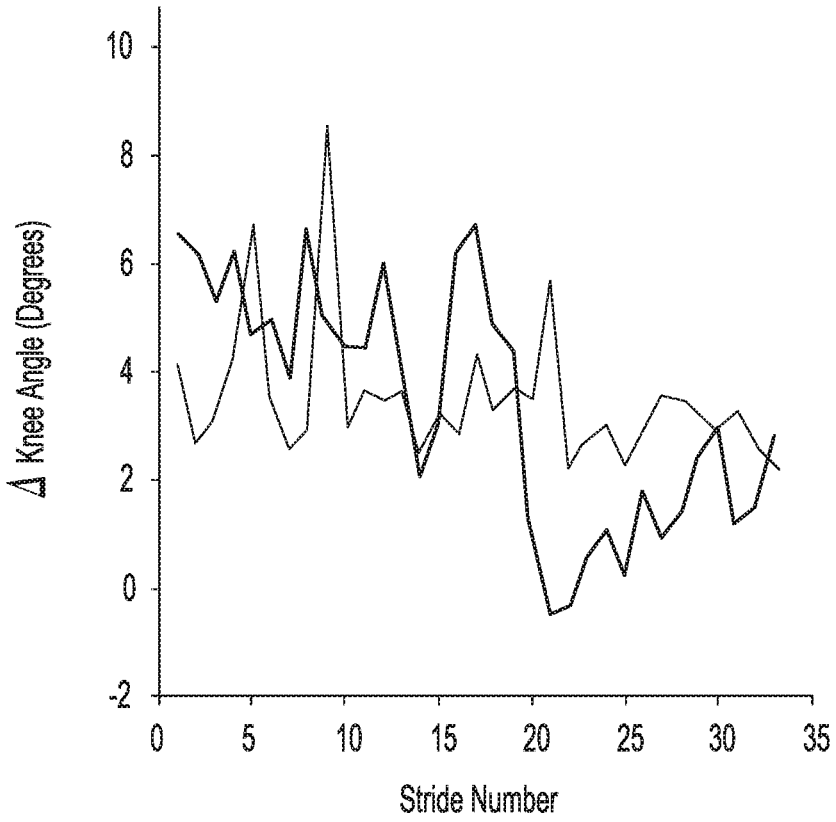
Figure 9B:
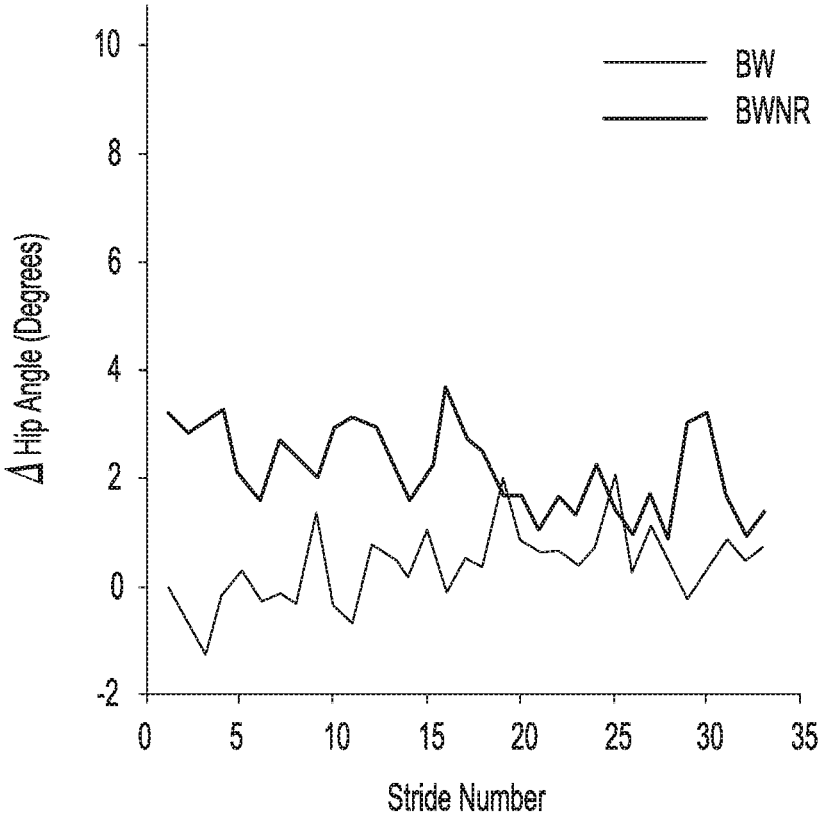

FIGS. 9A-9B shows a change in the kinematics of the hip and knee joints that occurs when the resistance is removed, knows as aftereffects to those who are skilled in the art, after walking with an embodiment of the device on the knee. These changes can last several strides following the removal of resistance and are a means to show changes in neural control strategies that occur due to training.

Figure 10:
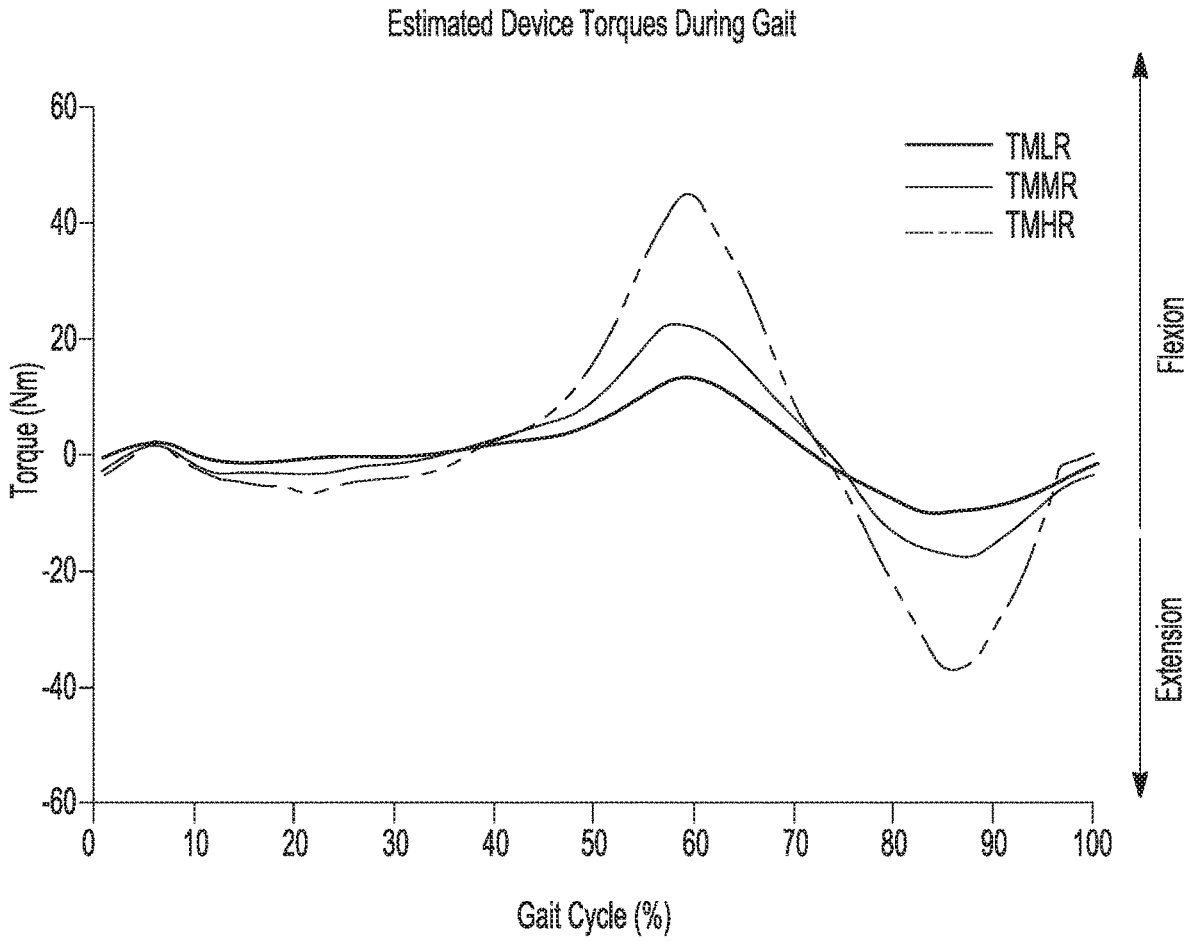

FIG. 10 shows estimated torques output from an embodiment of the device worn on the knee while walking and receiving feedback through the device. TMLR, TMMR, and TMHR are averages traces depicting the torque output at low, medium, and high resistances, respectively, and correspond to a single stride.

Figures 11A, 11B, 11C, 11D, 11E, 11F, 11G, 11H, 11I, 11J:
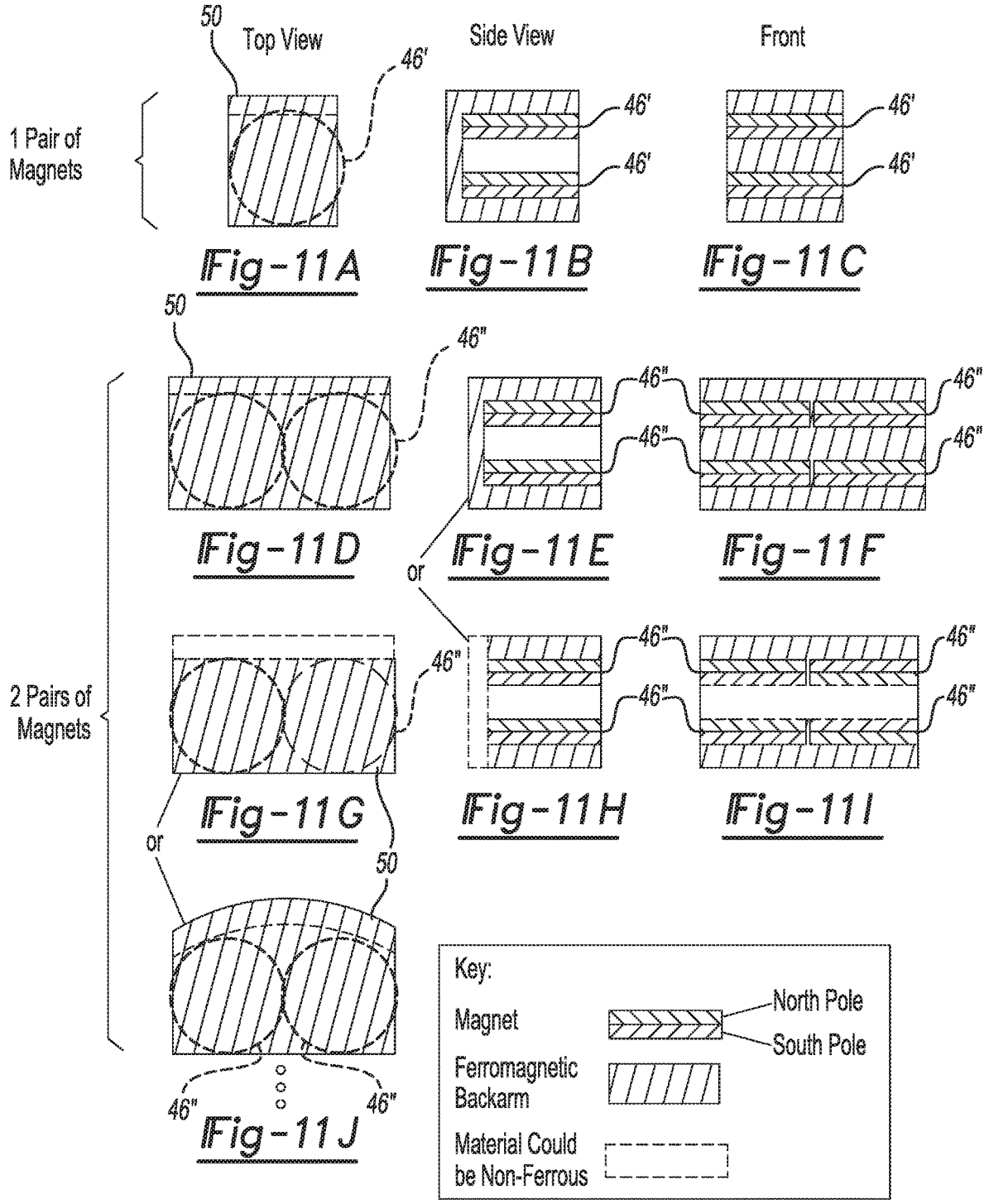

FIGS. 11A-11C is a top view, side view, and front view, respectively, of a magnetic assembly according to some embodiments of the present teachings with a single magnet pair.

FIGS. 11D-11F is a top view, side view, and front view, respectively, of a magnetic assembly according to some embodiments of the present teachings with two magnet pairs physically connected through the back arm.

FIGS. 11G-11I is a top view, side view, and front view, respectively, of a magnetic assembly according to some embodiments of the present teachings with two magnet pairs not physically connected through the back arm.

FIG. 11J is a top view illustrating the back arm according to some embodiments.

Figure 12:
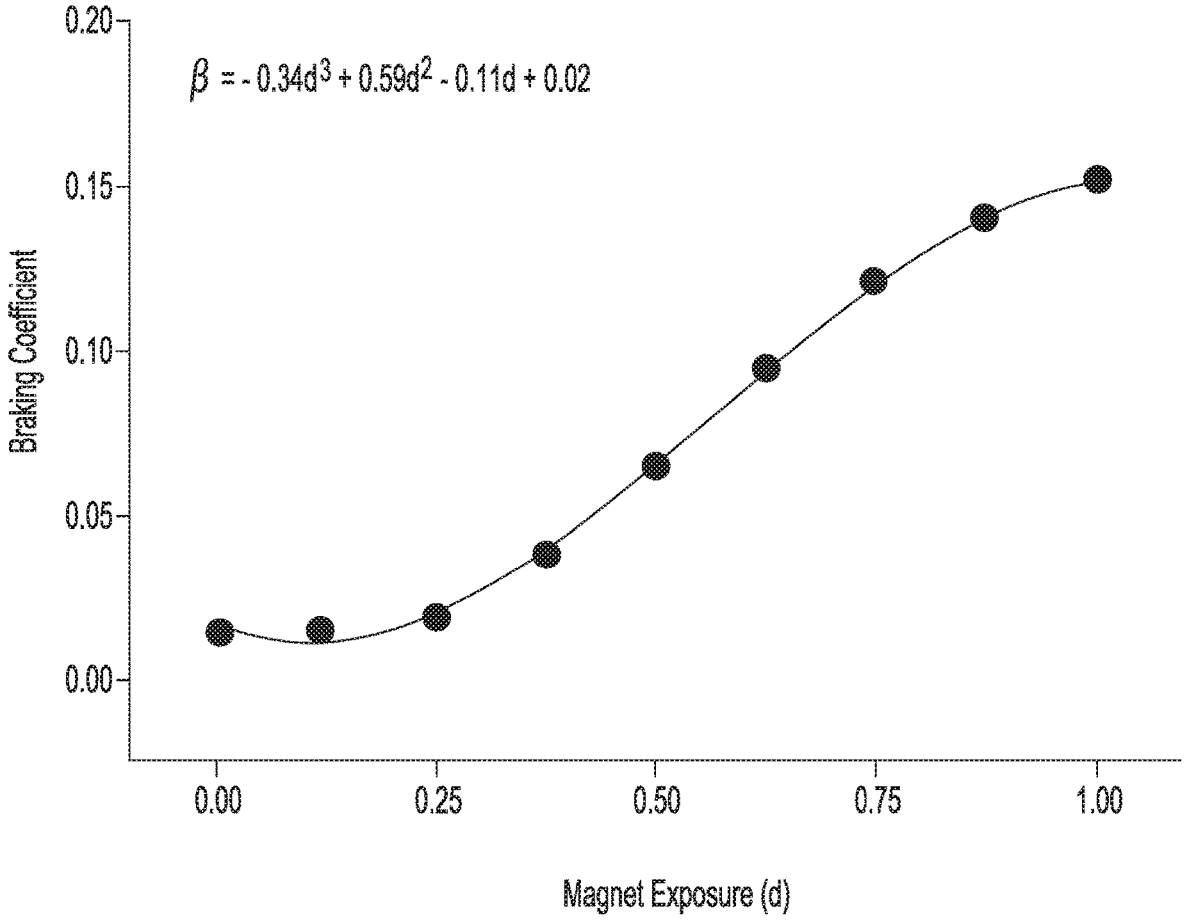

FIG. 12 is a graph illustrating the relationship of braking coefficient to magnet exposure.

Corresponding reference numerals indicate corresponding parts throughout the several views of the drawings.

DETAILED DESCRIPTION

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The principles of the present teachings and the associated development process were developed according to two phases: (1) development of a miniature eddy current brake that can be used for wearable applications, (2) development of a lightweight wearable device that provides resistance to the leg during walking or other extremity during use, and (3) evaluation of the effects of the wearable resistive device 10 involving healthy human subjects.

Eddy Current Braking for Functional Strength Training

According to the present teachings, a wearable resistive device 10 was created with the goal of providing resistance across the joint during movement, such as the knee or elbow. In order to accomplish this, a benchtop viscous damping device was created in the form of an eddy current disc brake 12, and later adapted to a commercially available knee brace.

Figure 1A:
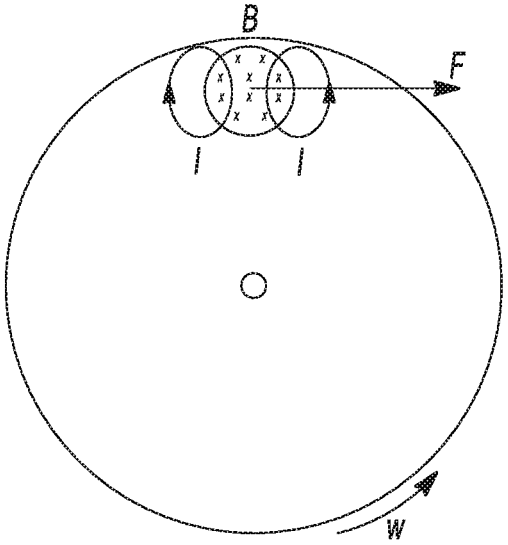
FIG. 1B illustrates some of the principles that affect the magnitude of the torque experienced during braking based on equation (1), according to the present teachings.
FIG. 1C illustrates an experimental set-up of benchtop testing.

Generally, eddy current brakes convert kinetic energy into electrical currents with the motion of a conductor through a magnetic field. Eddy currents, which are localized circular electric currents I within a conductor, slow or stop a moving object by dissipating kinetic energy as heat, thus providing a non-contact dissipative force F that is proportional and opposite to the velocity of the movement ω, as illustrated in FIG. 1A. Eddy current braking has been widely used in applications, such as trains, roller-coasters, and even some exercise equipment (i.e., stationary bikes); however, it has not been miniaturized and made wearable for rehabilitation purposes.

This method of resistance (i.e. eddy current braking) provides a smooth, contact free, and frictionless means of generating loads applied directly to the joint that can further be engineered into a compact and lightweight device as described herein.

The most widely studied configuration of eddy current braking is that of a rotational disc. Previous research performed over the past several decades has determined many of the parameters that govern the phenomenon. This work is summarized for eddy current braking as it applies to haptic devices:

$$\tau=\sigma*A*d*B^2*R^2*\omega \quad (1)$$

Figure 1B:
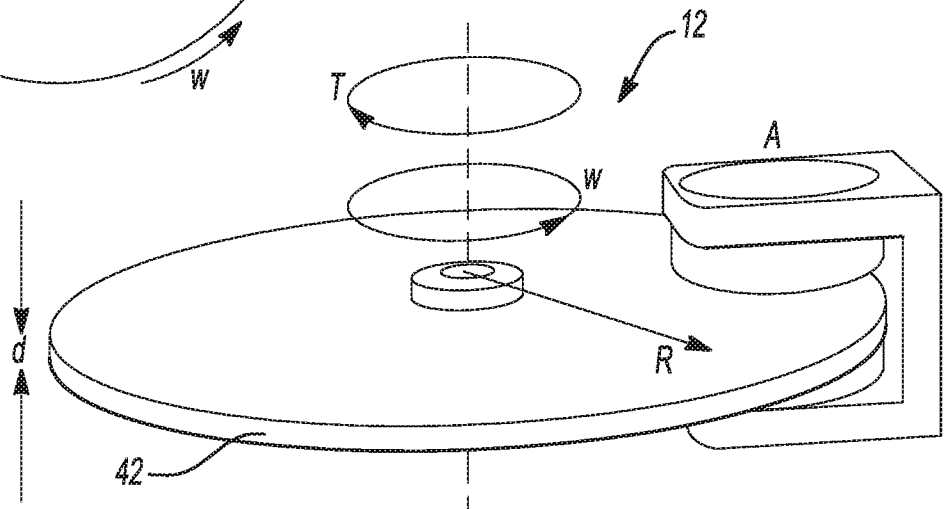

In this equation, resistive torque τ depends on the conductivity of the disc material σ, area of the disc exposed to the magnetic field A, the thickness of the disc d, the magnitude of the magnetic field strength B, the effective radius of the disc R, and the angular velocity of the disc rotation ω, as shown in FIG. 1B. In some embodiments of the art, this means that simply changing the area of the aluminum disc exposed to the magnetic field can change the resistive properties of the wearable resistive device 10.

In some embodiments, such as in a benchtop device, the eddy current disk brake 12 may be connected to a rigid structure for testing or training purposes. Two pairs of permanent magnets (DX08B-N52, KJ Magnetics, Pipersville, Pa.) mounted on a ferromagnetic backiron were used to create a magnetic field. Eddy currents were induced within a non-ferrous, 10.16 cm (4 in) diameter aluminum disc (6061 aluminum alloy). Aluminum was chosen as the disc material because it is both lightweight and conductive, although aluminum is not specifically required. The disc was also interchangeable, which enabled testing of the effect of disc thickness (1 mm, 3 mm, and 5 mm) on the resistive torque generated by the wearable resistive device 10. The wearable resistive device 10 was outfitted with a gearbox (227 g, 2 stage, planetary) (P60, BaneBots, Loveland, Colo.) with a 26:1 ratio in order to amplify angular velocity of the disc as well as the torque applied to the leg or other extremity. However, this specific gear ration is not explicitly required.

Figure 1C:
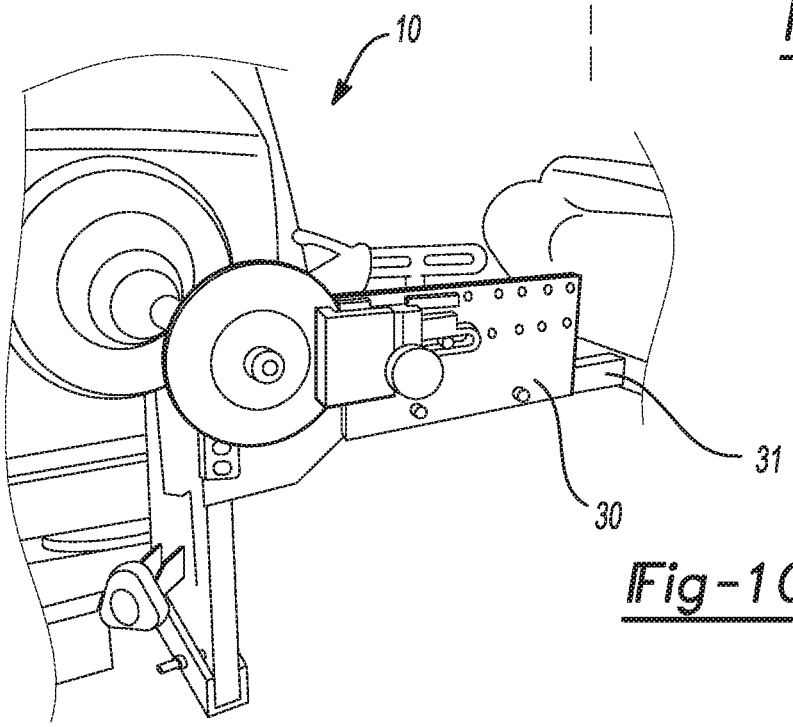
Figure 2C:
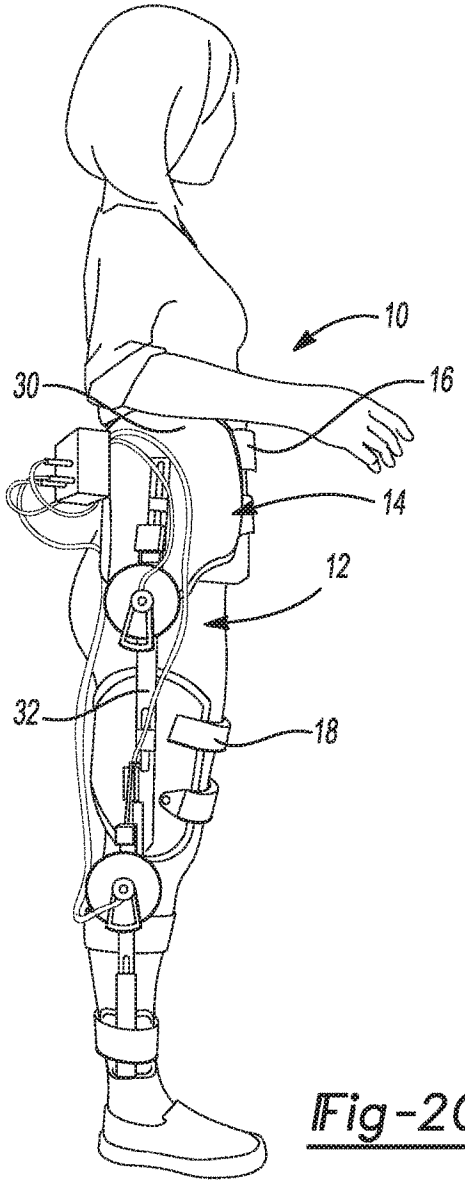
FIG. 2C is a perspective view of a wearable resistive device according to some embodiments of the present teachings being worn on the leg and hips of a user.
Figure 2B:
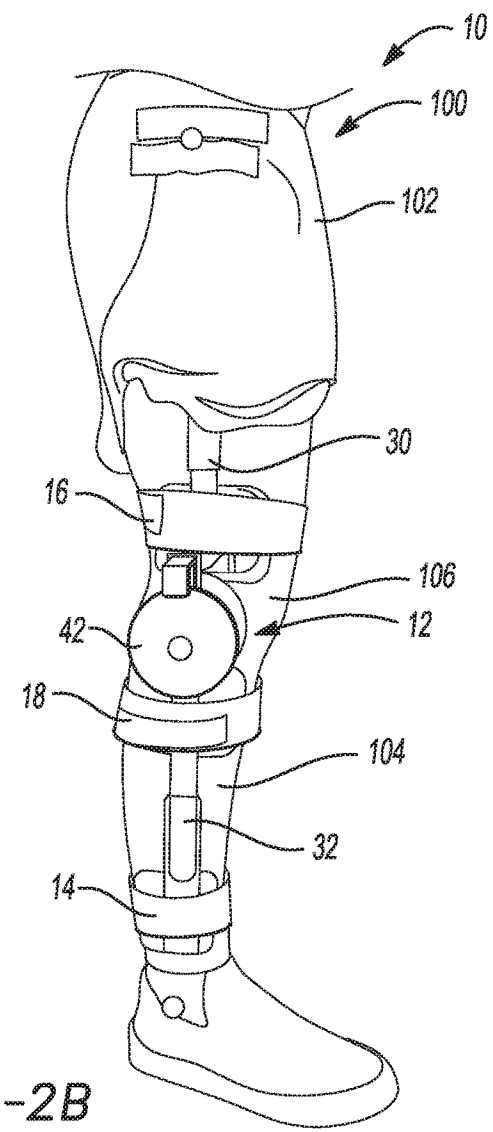
FIG. 2B is a perspective view of a wearable resistive device according to some embodiments of the present teachings being worn on the leg of a user.
Figure 2A:
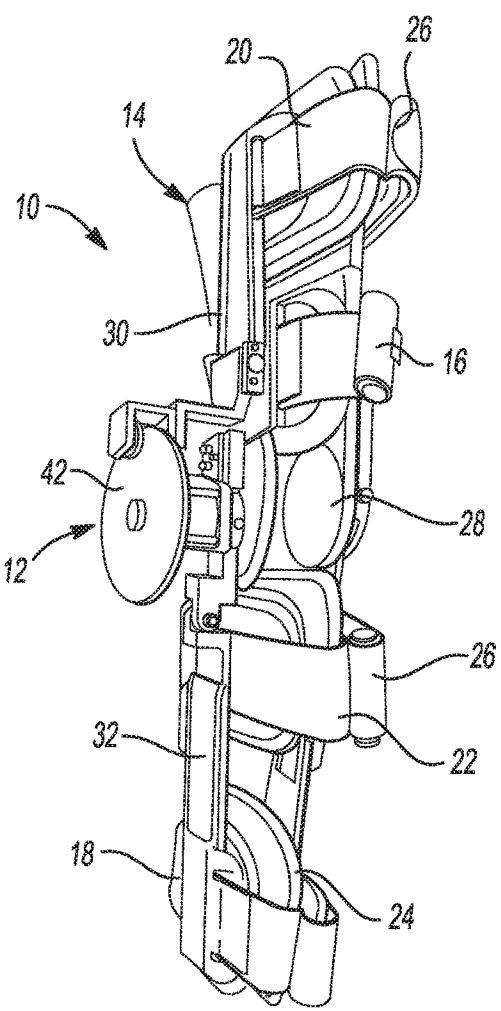
FIG. 2A is a perspective view of a wearable resistive device according to some embodiments of the present teachings.
Figure 2D:
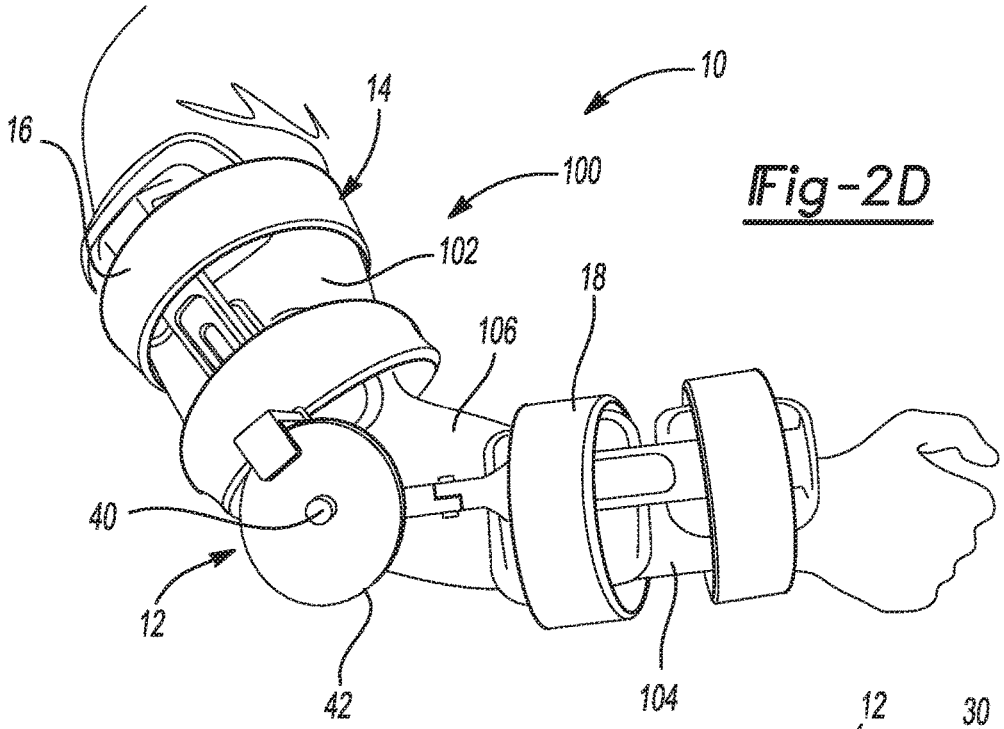
FIG. 2D is a perspective view of a wearable resistive device according to some embodiments of the present teachings being worn on the arm of a user.
Figure 2E:
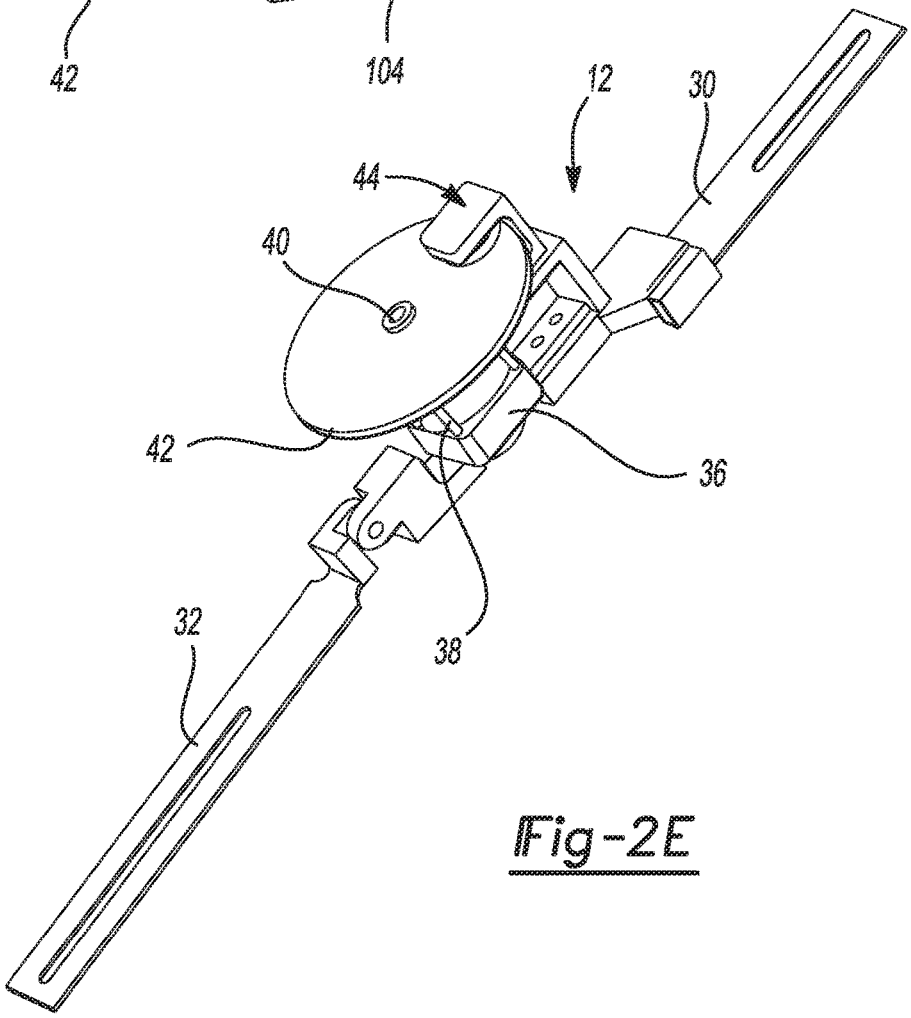
FIG. 2E is a perspective view of an eddy current braking system according to the principles of the present teachings.
Figure 3A:
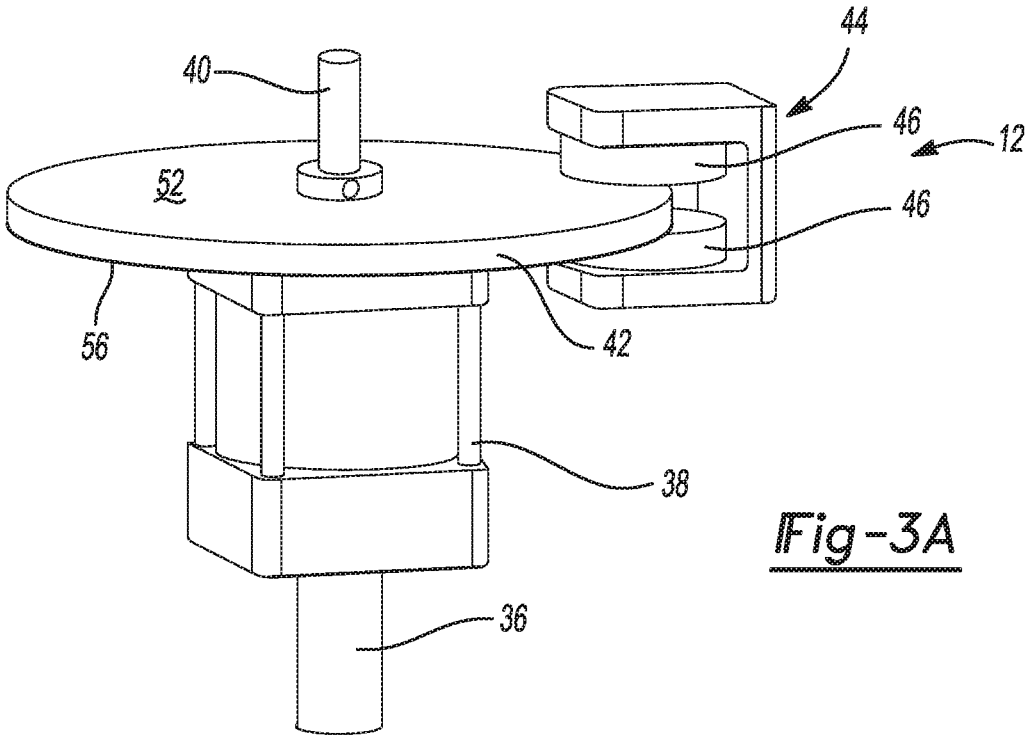
FIG. 3A is a perspective view of an eddy current brake system according to some embodiments of the present teachings.
Figure 3B:
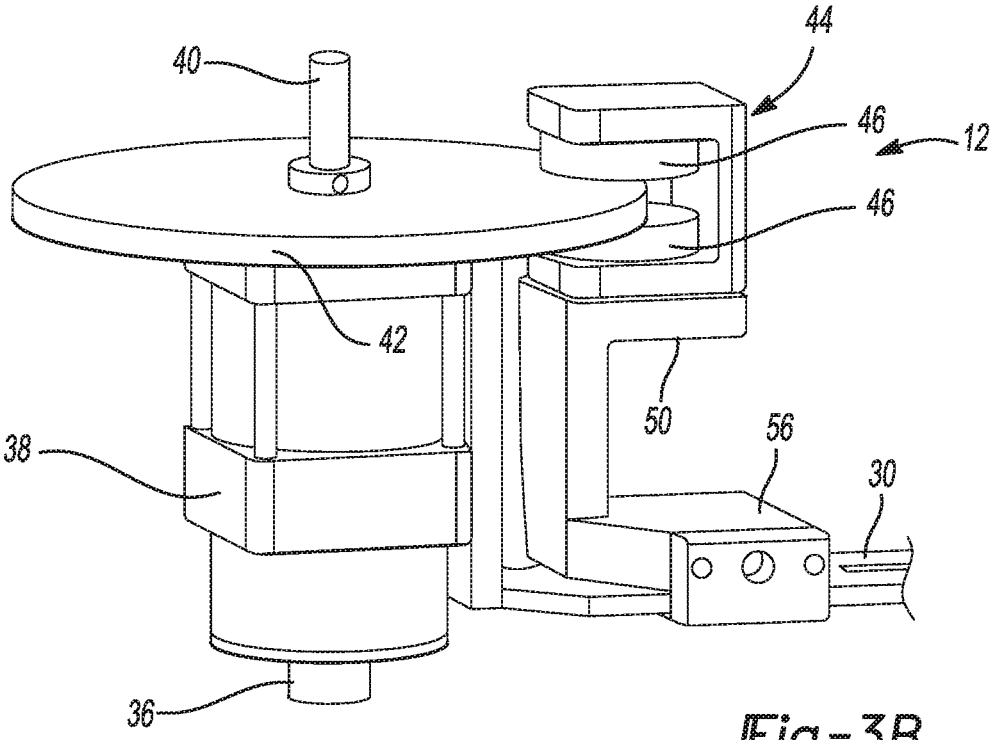
FIG. 3B is a perspective view of an eddy current brake system according to some embodiments of the present teachings having an adjustable back arm.
Figure 3C:
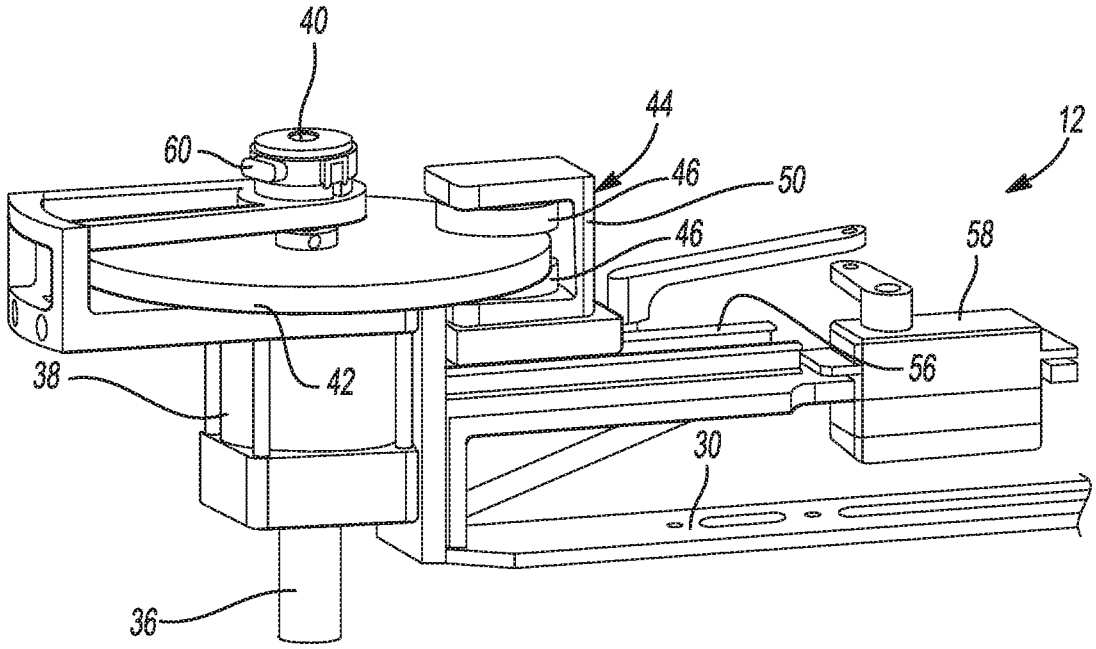
FIG. 3C is a perspective view of an eddy current brake system according to some embodiments of the present teachings having a servo-adjustable back arm and sensor system.
Figure 3D:
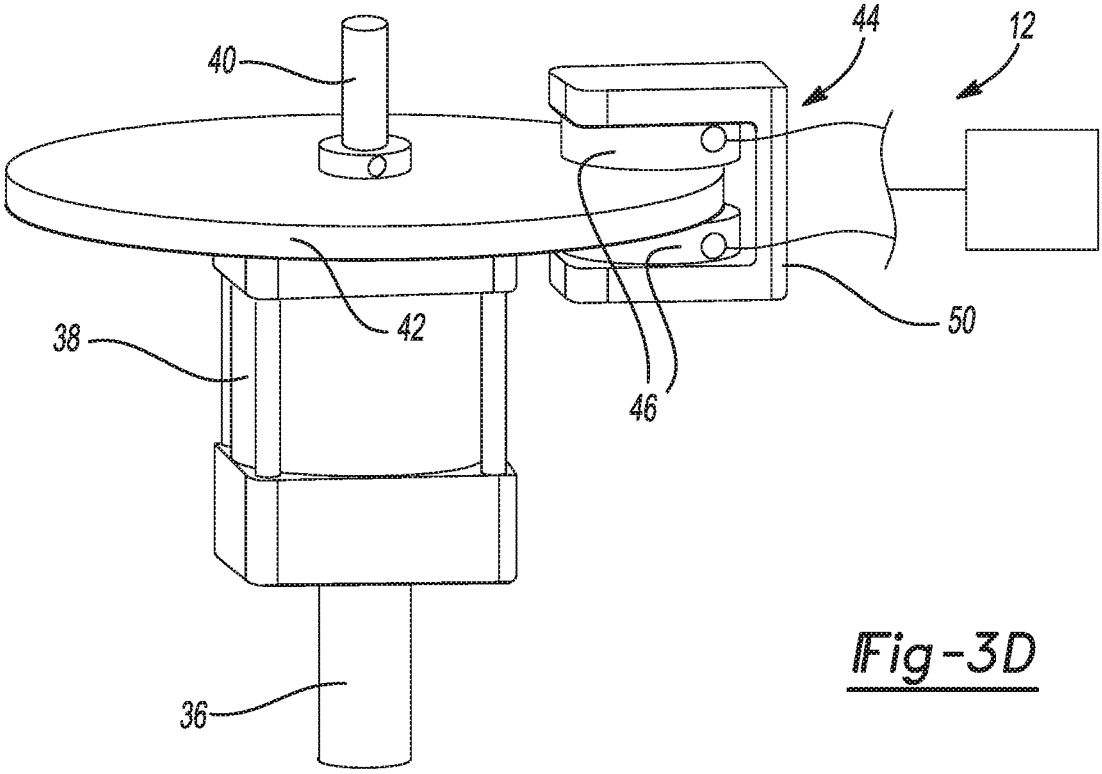
FIG. 3D is a perspective view of an eddy current brake system according to some embodiments of the present teachings having electromagnets.

The benchtop device 10 was then characterized for its resistive torque profile using an isokinetic dynamometer (System Pro 4, Biodex, Shirley, N.Y.). A custom built jig was used to rigidly attach the wearable resistive device 10 to the input arms of the dynamometer (FIG. 1C). Care was taken to ensure that the axis of the dynamometer was aligned with the rotational center of the benchtop device 10. The dynamometer was then programmed to operate in the isokinetic mode, where the input arm rotates at a specified angular velocity (10, 20, 30, and 45 degrees/s), while the resistive torque was logged using the dynamometer's built-in functionality. Between trials, the area of magnetic field exposed to the disc was set to full exposure, half exposure, or no exposure to cover a range of resistive settings possible with the wearable resistive device 10. The disc was then exchanged for one of a different thickness and repeated the testing. Five trials were performed at each angular velocity and the average was used in further analysis. After characterizing the resistive properties of the wearable resistive device 10, the parameters (magnet size, number, etc.) were then tuned to optimize wearability while maintaining a high resistance. The wearable resistive device 10 was then fitted to an orthopedic knee brace (see FIGS. 2A-2C) that can fit across a wide range of patient sizes (5' to 6'7"). The entire assembly weighed 1.6 kg (FIG. 2A).

As seen in FIGS. 2A-2E and 3A-3D, in some embodiments, the wearable resistive device 10 can comprise eddy current brake system 12 operably coupled to a brace structure assembly 14. It should be understood that brace structure assembly 14 can be configured for use on any extremity and/or joint of the human body, including, but not limited to, arm, leg, shoulder, elbow, wrist, hip, knee, ankle, torso, fingers, and the like. That is, although the present teachings are particularly described herein connection with a leg brace (see FIGS. 2A-2C), it should be understood that the principles of the present teachings are not limited to only legs and knee joints, but are applicable to any joint of the human body. Moreover, the principles of the present teachings can be employed to multiple extremities and/or joints simultaneously. Some embodiments may apply multiple of the eddy current brake system 12 to the same joint 106 so as to be resisting in parallel to each other. Similarly, the principles of the present teachings could be used on a tabletop or bench top device to provide resistance at the endpoint space instead of the joint space (e.g., providing resistance during reaching movements while the user performs the motion while holding a handle). It should also be noted that although a human body is of primary concern, the principles of the present teachings are equally applicable for use with animals.

With continued reference to FIGS. 2A-2D, the brace structure assembly 14 of the wearable resistive device 10 can comprise a first section 16 pivotally coupled to a second section 18. First section 16 can comprise one or more attachment features 20 configured to couple the first section 16 to a first body portion 102 of an extremity 100 (e.g. upper leg). The second section 18 can comprise one or more attachment features 22 configured to couple the second section 18 to a second body portion 104 of the extremity 100 (e.g. lower leg). The attachment features 20, 22 can each comprise one or more fastening or abutment pads 24 configured to engage and support the associated body portion 102, 104 of the extremity 100. The abutment pads 24 can be sized and shaped to be readily adapted to the user. Attachment features 20, 22 can further comprise one or more fastening systems 26, such as, but not limited to, straps, buckles, handles, and/or connectors. The first section 16 is pivotally coupled to the second section 18 via one or more pivotal joints 28. The pivotal joint 28 can be configured to permit rotation in a single plane and prevent or inhibit rotation in other planes, thereby restraining and isolating direction of movement of joint 106. However, in some embodiments, multiplane rotation can be used. If two or more pivotal joints 28 are used, they can be aligned such that their associated axis of rotation is coaxially aligned (see Line A-A of FIG. 2B).

The eddy current brake system 12 is operably coupled between the first section 16 and the second section 18 of the brace structure assembly 14. More particularly, in some embodiments, the eddy current brake system 12 can comprise a first rigid member 30 operably coupled to the first section 16 of the brace structure assembly 14 and a second rigid member 32 operably coupled to the second section 18 of the brace structure assembly 14. Similarly, in some embodiments, the eddy current brake system 12 can comprise a first rigid member 30 operably coupled to a rigid surface 31 and a second rigid member 32 operably coupled to the brace structure assembly 14. Some embodiments may require multiple of the eddy current brake system 12 connected in series, were the first rigid member 30 of one brake is operably coupled to the a second rigid member 32 of another brake. It should be understood that first rigid section 30 and second rigid section 32 can comprise a generally rigid beam member (see FIGS. 2A-2E) or can be integrally formed with first section 16 of brace structure assembly 14 and second section 18 of brace structure assembly 14, respectively. First rigid member 30 and second rigid member 32 is configured to carry resistive loading forces to/from the first portion 102 and second portion 104 of extremity 100.

In some embodiments, the eddy current brake system 12 further comprises an input shaft 36 operably coupled to a transmission system 38, a disk 42, and a magnetic assembly 44. In some embodiments, input shaft 36 is operably coupled to one of the first rigid member 30 or the second rigid member 32 (or directly to the corresponding rigid structure of the brace structure assembly 14) for movement therewith. In this regard, pivotal rotation of the corresponding first section 16 or second section 18 of the brace structure assembly 14 results in a rotational movement of the input shaft 36. Input shaft 36 is operably coupled to transmission system 38 to provide a gear ratio for increased shaft rotation of a driven shaft 40. The transmission system could be comprised of, but is not limited to, a gear box or system of intermeshing gears, pulley, belt, chain and sprocket, capstan, etc. In some embodiments, this gear ratio can be a 26:1 gear ratio such that input shaft 36 rotates 26 times slower than driven shaft 40. However, it should be understood that alternative gear ratios can be used. This results in an increase in angular velocity of the disk (omega); hence, the resistive torque felt at the input shaft 36 is amplified due to the increased angular velocity of the disk and by virtue of the gear ratio. Transmission system 38 has been found to improve the operation of the eddy current brake system 12 and provide decreased size and weight of eddy current brake system 12. In some embodiments, transmission system 38 can comprise a clutch or ratchet system such that resistance of wearable resistance device 10 only operates in one direction. In some embodiments, transmission system 38 can comprise a cable capstan mechanism.

In some embodiments, driven shaft 40 is fixedly coupled to disk 42 such that rotation of driven shaft 40 imparts rotation to disk 42 about an axis of driven shaft 40. In some embodiments, the axis of driven shaft 40 is coaxially aligned with input shaft 36. Moreover, in some embodiments, the axis of input shaft 36 is coaxially aligned with pivotal joint(s) 28 to ensure proper orientation and alignment of eddy current brake system 12, brace structure assembly 14, and joint 106 of extremity 100. However, this is not required, as a brace could include a self-aligning mechanism to decouple translation of the joint and rotation of the device. In some embodiments, disk 42 is made of a non-ferrous material, such as, but not limited to, aluminum or copper. In some embodiments, disk 42 can have a diameter of about four (4) inches. However, in some embodiments, disk 42 can have a diameter in the range of two (2) to six (6) inches.

In some embodiments, magnetic assembly 44 can comprise one or more magnets 46 disposed within a magnet housing 48. Magnet housing 48 can be fixedly coupled to one of the second rigid member 32 or the first rigid member 30 (or directly to the corresponding rigid structure of the brace structure assembly 14) for movement therewith via a back arm 50. It should be understood that magnet housing 48 and back arm 50 are coupled to the opposite rigid member 32, 30 than that of input shaft 36, such that input shaft 36 and magnet housing 48 are carried by separate rigid members 30, 32. In some embodiments, magnet 46 comprises one or more pairs of magnets spaced on opposing side faces 52, 54 of disk 42. In some embodiments, magnets 46 can comprise permanent magnets made from but not limited to neodymium rare earth metal. In some embodiments, back arm 50 can be slidably adjustable.

With particular reference to FIGS. 11A-11J, magnetic assembly 44 is illustrated according to various embodiments. With reference to FIGS. 11A-11C, in some embodiments, a single magnet pair 46' can be a single magnet pair. It should be understood that in this configuration, single magnet pair 46' must be oriented such that each of the pair has their poles facing each other (i.e. North-South:North-South) and are physically connected through the back arm 50. With reference to FIGS. 11D-11I, two magnet pairs 46" can be employed. In the embodiment of FIGS. 11D-11F, the two magnet pairs 46" are oriented such that each of the pair has their poles facing each other (i.e. North-South:North-South) and are physically connected through the back arm 50. In the embodiment of FIGS. 11G-11I, the two magnet pairs 46" are oriented such that each of the pair has their poles facing each other (i.e. North-South:North-South), but are opposite of the other pair, and are not necessarily physically connected through back arm 50. It should be understood, as illustrated in FIG. 11J, back arm 50 can have any one of a number of shapes. It should also be understood that additional magnet pairs can be used.

As set forth herein, resistive torque needs to be modified based on the equations herein. To this end, back arm 50 can be moved relative to disk 42 to change the area (A in the equation) of the magnets 46 exposed to the disk 42 by a movement mechanism 56 configured to radially move (i.e. move toward or away from axis of the disk 42) the magnets 46 toward or away from disk 42, with some component of the movement acting radially. It should be understood that movement mechanism or slider 56 can be manual or computer controlled. In computer-controlled embodiments, a servo motor 58 can be used in order to electronically control the exposure of the magnets 46 via a linear slider. However, alternative actuators such as but not limited to linear actuators, ball screw mechanisms, timing or pulley belts, pressurized cylinders, and magnetic actuators can be used.

In some embodiments, magnets 46 can comprise electromagnets. In this regard, instead of permanent magnets that may require sliding systems, electromagnets, where current changes the magnetic field strength, can be used to modify the resistive forces.

It should be understood that one or more force sensors can be added to measure and track the corresponding resistive forces of the assemblies. Similarly, an encoder 60 can be coupled to disk 42 and monitor any parameter of the system, including but not limited to position, velocity, and acceleration of the eddy current brake system 12. This can be used to provide feedback to the user and/or caregiver.

However, as illustrated in FIG. 12, because eddy current brake system 12 is velocity dependent, it is not necessary to have a load cell or force sensor. Eddy current brake system 12 can be calibrated so that if one knows the velocity (i.e., using the encoder), one can sense the resistance. This calibration could be performed for any variable in the above equations (i.e., magnet strength, number of magnets, etc.). However, according to the present disclosure, the magnets exposure to the disk, and thus, the area in the equation is used.

Human Subject Experiment

During phase two, the biomechanical effects of the wearable resistive device were tested on human subjects during a brief walking exercise under various loading conditions. Subjects (n=7) with no signs of neurological or orthopedic impairment participated in the study. Prior to the experiment, three 19 mm diameter retroreflective markers were placed over the subject's right greater trochanter, lateral femoral epicondyle, and lateral malleolus. Additionally, eight surface electromyographic (EMG) electrodes (Trigno, Delsys, Natick, Mass.) were placed over the muscle bellies of vastus medialis (VM), rectus femoris (RF), medial hamstring (MH), lateral hamstring (LH), tibialis anterior (TA), medial gastrocnemius (MG), soleus (SO), and gluteus medius (GM) according to the established guidelines (www.seniam.org). The EMG electrodes were tightly secured to the skin using self-adhesive tapes and cotton elastic bandages. The quality of the EMG signals was visually inspected to ensure that the electrodes were appropriately placed. The participant then performed maximum voluntary contractions (MVCs) of their hip abductors, knee extensors, knee flexors, ankle dorsiflexors, and ankle plantar flexors against a manually imposed resistance. The EMG activities obtained during the maximum contractions were used to normalize the EMG data obtained during walking.

The EMG and kinematic data were collected using custom software written in LabVIEW 2011 (National Instruments Corp., Austin, Tex., USA). EMG data were recorded at 1000 Hz, and the kinematic data were recorded at 30 Hz using a real-time tracking system described elsewhere. Briefly, retroreflective markers placed on the hip, knee, and ankle joints were tracked using an image processing algorithm written in LabVIEW Vision Assistant. A three-point model was then created from the hip, knee, and ankle markers to obtain sagittal plane hip and knee kinematics using the following equations:

$$\theta_{Hip}=\arctan 2([x_{knee}-x_{hip}]|[y_{hip}-y_{knee}]) \quad (2)$$

$$\theta_{Knee}=(90-\text{Hip Angle})-(\arctan 2([y_{ankle}-y_{knee}]|[x_{ankle}-x_{knee}])) \quad (3)$$

Where $\theta_{Hip}$ (relative to the vertical trunk) and $\theta_{Knee}$ represent the anatomical joint angles, $x_{hip}$, $x_{knee}$ and $x_{ankle}$ represent the x-coordinates, and $y_{hip}$, $y_{knee}$ and $y_{ankle}$ represent the y-coordinates of the markers over the respective anatomical landmarks.

Experimental Protocol

A schematic of the experimental protocol is given in FIG. 4A. Testing began by having the subject walk on a treadmill (Woodway USA, Waukesha, Wis.) at 2 mph. A two-minute warm-up period was provided, after which the subject performed a baseline walking trial (pre-BW) for one minute. The subject then wore the resistive brace (with a marker on its joint axis) on their right leg and performed nine walking trials, with each trial lasting one minute. A one-minute rest period was provided between each trial. With the wearable resistive device 10, the subject first performed one baseline walking with no resistance (pre-BWNR) to characterize the transparency of the wearable resistive device 10. The subject then performed two more baseline walking trials where the wearable resistive device 10 was set to provide either medium (BWMR) or high resistance (BWHR). Following which, the subject performed three target matching (TM) trials where they viewed the ensemble average of their pre-BWNR foot trajectory on the monitor and attempted to match their foot trajectory with the target. The foot trajectory refers to the x-y position of the lateral malleolus with respect to the subject's greater trochanter in the sagittal plane (FIG. 4B), and was computed using a forward-kinematic model that used hip and knee joint angles and the segment lengths of the thigh and shank. This trajectory was given as feedback, similar to how an embodiment of the device 10 could be used to provide feedback to the user.

The target matching trials were performed for two reasons: (1) matching the template ensured that their hip and knee kinematics were similar to their unresisted baseline walking kinematics and (2) it allowed us to evaluate the feasibility of combining functional strength training with a motor learning task. During the three target matching trials, the resistance was set to low, medium, or high (corresponding to a quarter, half, and full magnetic exposure to the disc) to study the biomechanical effects of the wearable resistive device 10 over a range of resistance settings. These trials were accordingly named as target matching with low resistance (TMLR), target matching with medium resistance (TMMR), and target matching with high resistance (TMHR). Following the target matching trials, the subject repeated the baseline walking with no resistance (post-BWNR) and baseline walking with no device (post-BW) trials. These trials were performed to see if there were any sustained changes in kinematics (i.e., aftereffects) as seen in FIGS. 9A-9B.

Data Analyses

Electromyography

The effect of wearable resistive device 10 on muscle activation was evaluated through the changes in EMG amplitude between walking conditions. These data can be found in FIGS. 6A-6H and FIGS. 8A-8H for each muscle over the gait cycle. The recorded raw EMG data were band-pass filtered (20-500 Hz), rectified, and smoothed using a zero phase-lag low-pass Butterworth digital filter ($8^{th}$ order, 6 Hz Cut-off). The resulting EMG profiles for baseline and target matching conditions were normalized using MVC contractions and ensemble averaged across strides to compute mean EMG profiles during each condition (EMG data of soleus muscle from one subject were excluded from the analysis due to electrode malfunction). Gait events were identified using accelerometer data collected from the Trigno™ EMG sensors. Ensemble averages of the gait cycle were then divided into two bins corresponding to the stance and swing phases of gait, and the average EMG activity was computed during each phase.

Kinematics

The kinematic data were ensemble averaged across strides and subjects to compute average profiles for each walking condition (FIGS. 7A-7D). The hip and knee excursions during baseline and target matching trials were calculated for each stride and averaged to determine the effect of resistive walking on sagittal plane kinematics, and to test the feasibility of target tracking during resisted walking. The hip and knee excursions during the first ten strides of the initial and final baseline walking conditions (i.e., pre-BW, pre-BWNR, post-BW, and post-BWNR) was averaged to recognize any short-lived aftereffects following the brief training with the resistive brace (FIGS. 9A-9B).

Additionally, the instantaneous angular velocity of the knee joint during the target matching trials was calculated to estimate the resistance felt by the knee throughout the gait cycle.

Statistical Analyses

All statistical analyses were performed using SPSS for windows version 22.0 (SPSS Inc., Chicago, Ill., USA). Descriptive statistics were computed for each variable and for assessing the results of benchtop testing. Prior to statistical analysis, the EMG data were log transformed ($\log_e$EMG) to minimize skewness and heteroscedasticity. To examine the effect of the wearable resistive device 10 on subjects' muscle activation and joint kinematics during baseline walking, a linear mixed model analysis of variance (ANOVA) with trial (pre-BWNR, BWLR, BWMR, and BWHR) as a fixed factor and subject as a random factor was performed for each muscle during each time bin. A significant main effect was followed by post-hoc analyses using paired t-tests with Šidák-Holm correction for multiple comparisons to compare resisted baseline walking trials (i.e., BWMR and BWHR) with the unresisted baseline walking trial (i.e., pre-BWNR).

To examine the effect of the wearable resistive device 10 on subjects' muscle activation and joint kinematics during target matching trials, another linear mixed model ANOVA with trial (pre-BWNR, TMLR, TMMR, TMHR) as a fixed factor and subject as a random factor was performed for each muscle during each time bin. A significant main effect was followed by post-hoc analyses using paired t-tests with Šidák-Holm correction for multiple comparisons to compare resisted target matching trials (i.e., TMLR, TMMR, and TMHR) with the unresisted baseline walking trial (i.e., pre-BWNR). In order to evaluate the transparency of the wearable resistive device 10, paired t-tests were used to compare differences in muscle activation and joint kinematics between baseline walking with no device and baseline walking with no resistance trials (i.e., pre-BW and pre-BWNR).

Paired t-tests were also used to compare differences in hip and knee joint excursions during the first ten strides between the pre-baseline and post-baseline walking trials (i.e., pre-BW vs. post-BW and pre-BWNR vs. post-BWNR) to identify significant aftereffects. A significance level of $\alpha=0.05$ was used for all statistical analyses.

Results

Benchtop Testing

The results of bench top testing verified that eddy current braking torque scaled linearly with velocity at the speeds used in this study (FIG. 5A-5C). The resistive torque was also proportional to the area of magnetic field exposed to the disc and the thickness of the disc; however, torque appeared to plateau after 3 mm of disc thickness (FIG. 5B).

Additionally, the maximum resistive torque attained using this small, portable form of eddy current braking was substantially large (26.85 N·m at 45 degrees per second using a 5 mm thick disc; FIG. 5C). This observation suggested that the benchtop device was capable of generating a peak torque of about 180 N·m during normal gait because the peak angular velocity of the knee during normal gait can exceed 300 degrees per second. This meant that the size and strength of the magnets used in the wearable resistive device 10, and therefore the weight, could be greatly reduced while still providing sufficient torque for functional strength training. For this reason, the number of magnetic pairs used for braking was reduced from two to one, while the strength of the magnets was reduced by about half (DX04B-N52, KJ Magnetics, Pipersville, Pa.) before fitting the wearable resistive device 10 to the leg brace. The new brake was thus capable of providing about 56 N·m of torque during normal gait.

Human Subjects Experiment

Electromyographic Changes During Baseline Walking

The muscle activation profiles observed during baseline walking trials are summarized in FIGS. 6A-6H. There was a significant main effect of trial on EMG activity of vastus medialis [F(2,12)=7.823; p=0.007], medial gastrocnemius [F(2,12)=17.696; p<0.001], and soleus [F(2,10)=5.021; p=0.031] during the stance phase of gait. Post-hoc analysis indicated that the EMG activity of vastus medialis was significantly higher during resisted walking than during unresisted walking (FIG. 6A) [BWMR: p=0.020; BWHR: p=0.006]. On the contrary, the medial gastrocnemius and soleus had significantly lower activation during resisted walking (FIGS. 6F-6G) [MG BWMR: p=0.046; MG BWHR: p<0.001; SO BWHR: p=0.021]. There was a significant main effect of trial on EMG activity of tibialis anterior [F(2,12)=4.026; p=0.046] and soleus [F(2,10)=4.187; p=0.048] during the swing phase of gait. Post-hoc analysis showed a significant increase in soleus activation (FIG. 6G) [BWHR: p=0.032] and a trend towards significantly higher tibialis anterior activation (FIG. 6E) [BWMR: p=0.056; BWHR: p=0.063] during resisted walking.

Kinematic Changes During Baseline Walking

Figure 7A:
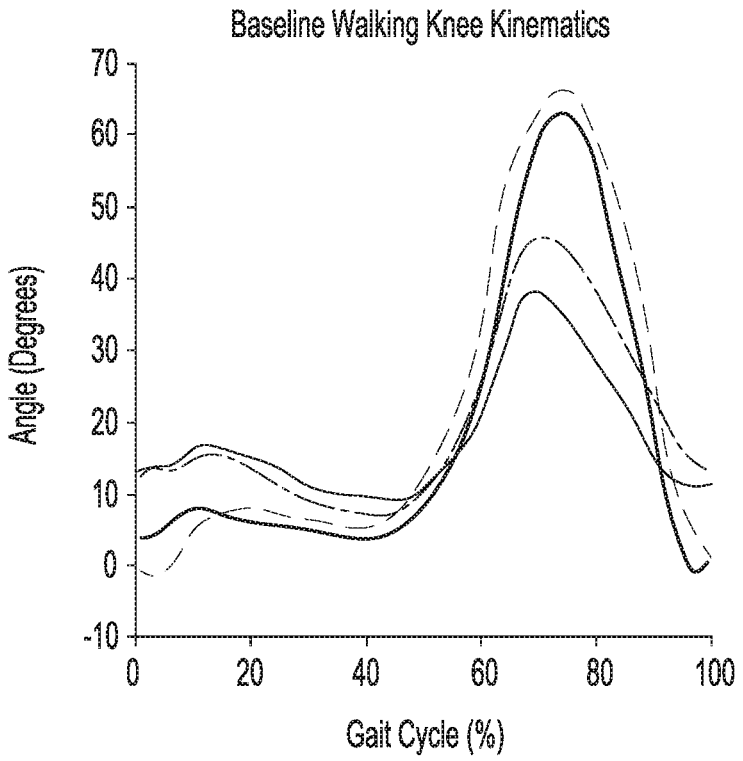
Figure 7B:
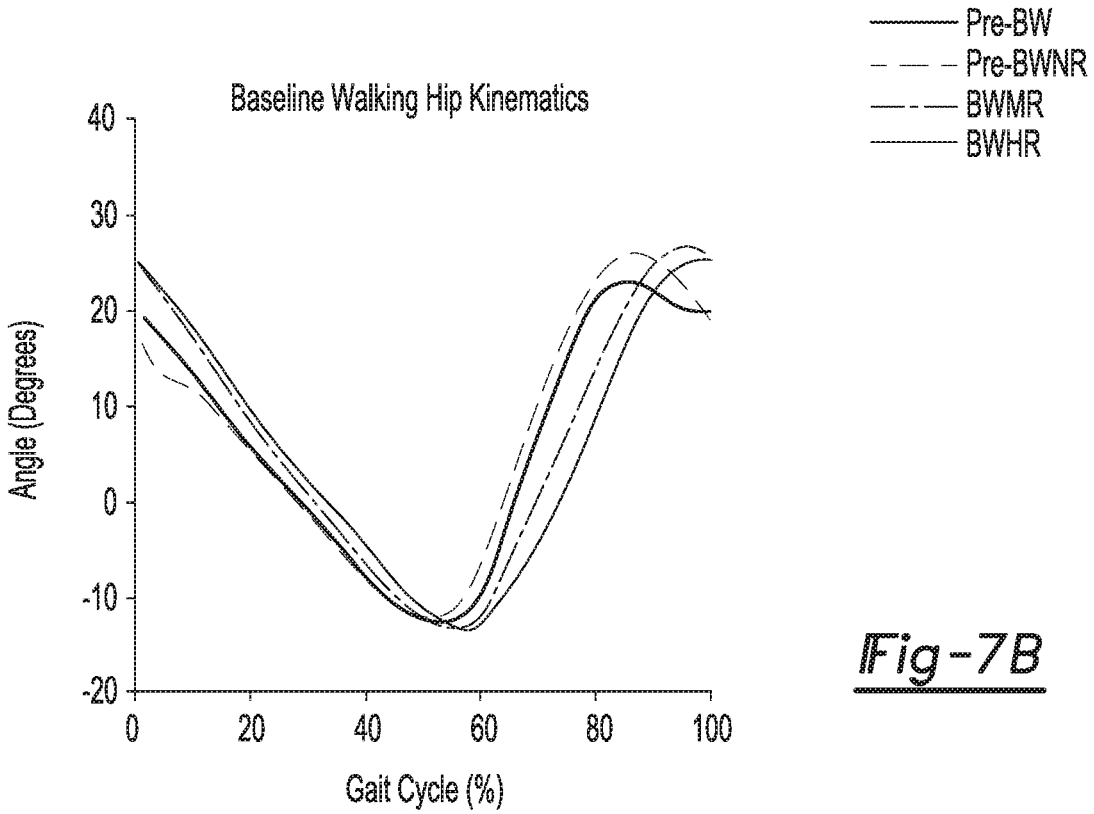

There was a significant main effect of trial on knee joint excursion during baseline walking [F(2,12)=96.327; p<0.001] with the wearable resistive device 10; however, no changes were observed for the hip joint [F(2,12)=0.593; p=0.568] (FIGS. 7A-7B). Post-hoc analysis showed a significant reduction in knee joint excursion during resisted walking than during unresisted walking (FIG. 7A) [BWMR: −28.6±8.0°, p<0.001; BWHR: −37.1±8.3°, p<0.001].

Electromyographic Changes During Target Matching

The muscle activation profiles observed during target matching trials are summarized in FIGS. 8A-8H. There was a significant main effect of trial on EMG activity of vastus medialis [F(3,18)=14.086; p<0.001], rectus femoris [F(3,18)=6.672; p=0.003], medial hamstring [F(3,18)=4.034; p=0.023], lateral hamstring [F(3,18)=7.268; p=0.002] and gluteus maximus [F(3,18)=6.619; p=0.003] during the stance phase of gait. Post-hoc analysis indicated that the EMG activity was significantly greater during resisted target matching trials for the vastus medialis (FIG. 8A) [TMMR: p<0.001; TMHR: p<0.001], rectus femoris (FIG. 8B) [TMMR: p=0.016; TMHR: p=0.006], lateral hamstring (FIG. 8D) [TMHR: p=0.011], and gluteus medius (FIG. 8H) [TMMR: p=0.028; TMHR: p=0.005] muscles.

There was a significant main effect of trial on EMG activity of all the muscles during the swing phase of gait [F(3,18)=4.871 to 27.519; p=0.015 to p<0.001]. Post-hoc analysis indicated the EMG activity was significantly greater during resisted target matching trials when compared with the unresisted baseline walking for all the muscles tested (FIGS. 8A-8H) [p=0.036 to p<0.001].

Kinematic Changes During Target Matching

Figure 7C:
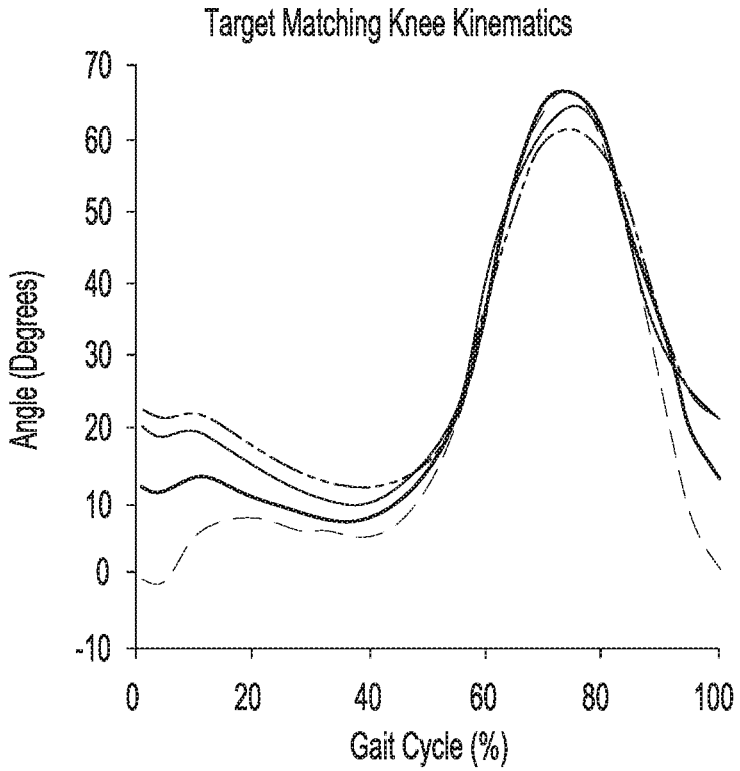
Figure 7D:
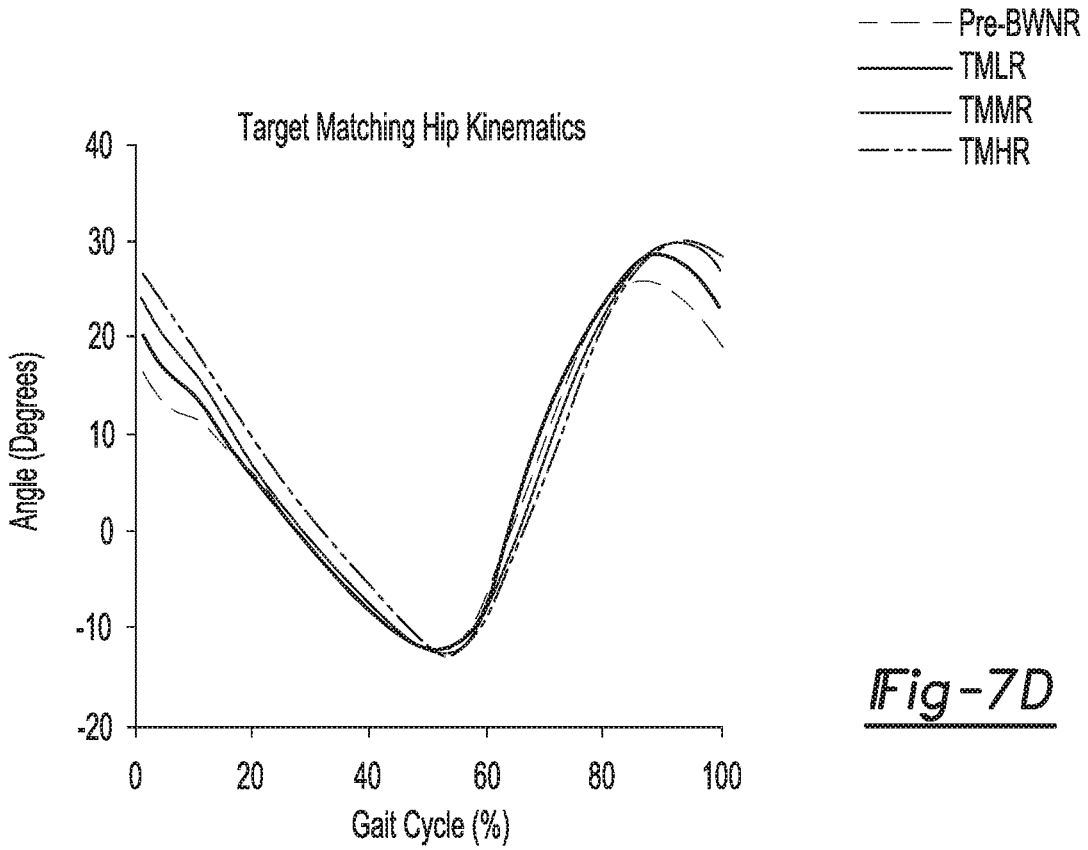
Figures 8A, 8B:
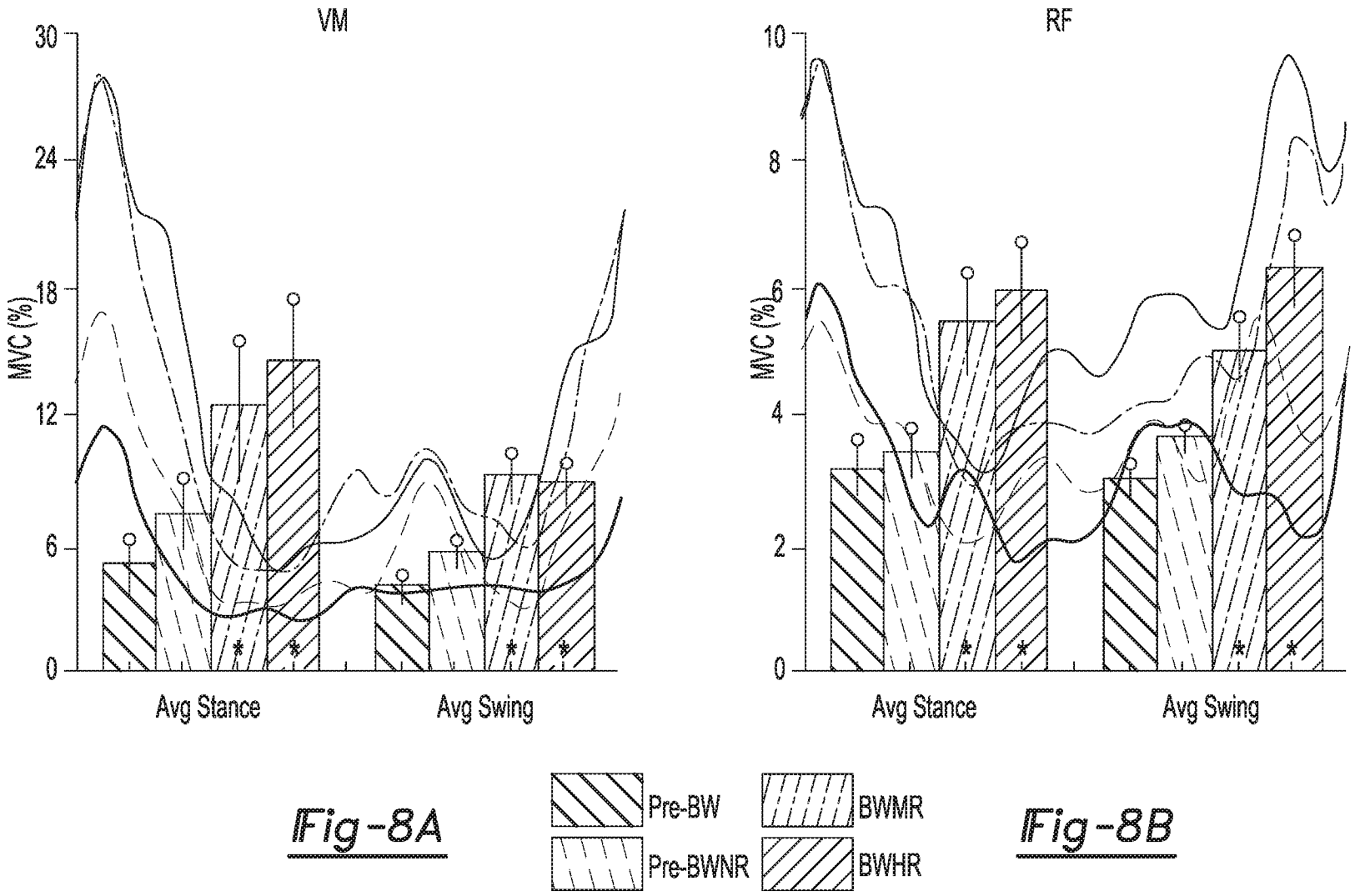
Figure 8D:
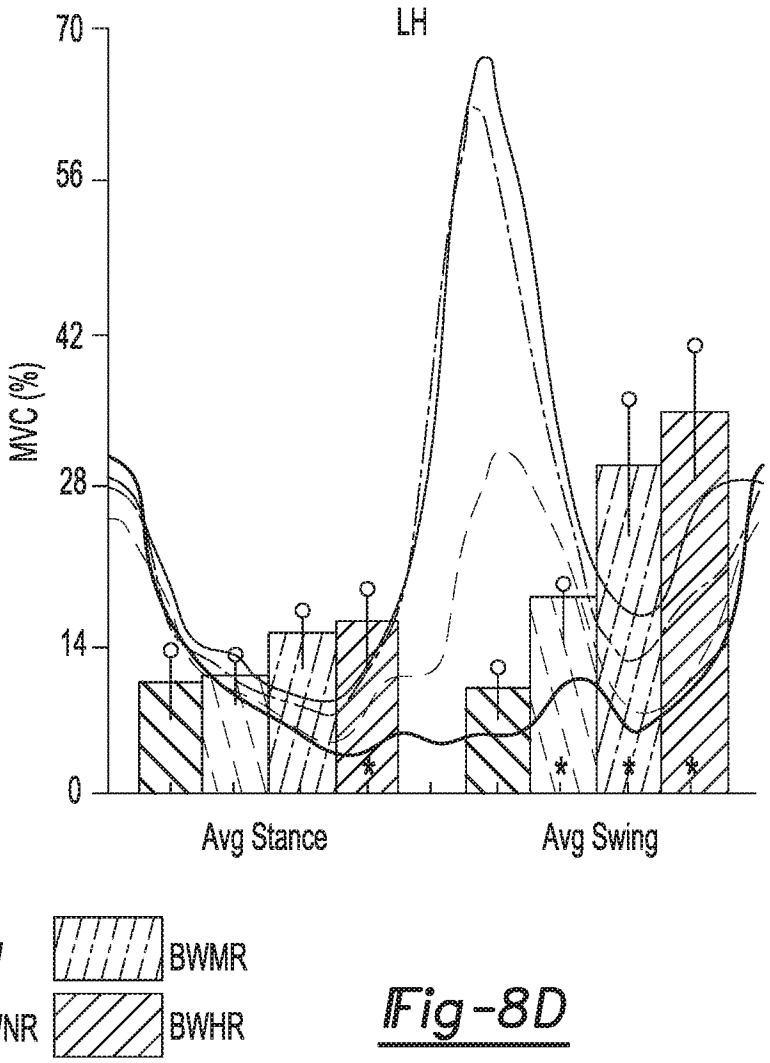
Figure 8C:
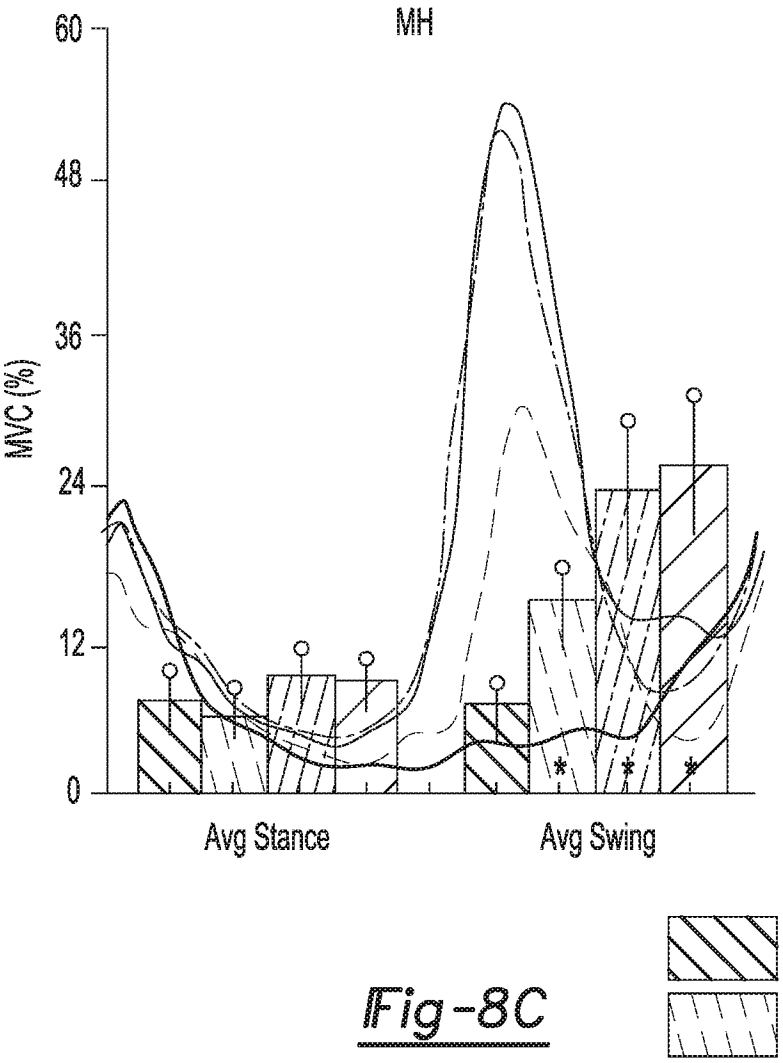
Figure 8F:
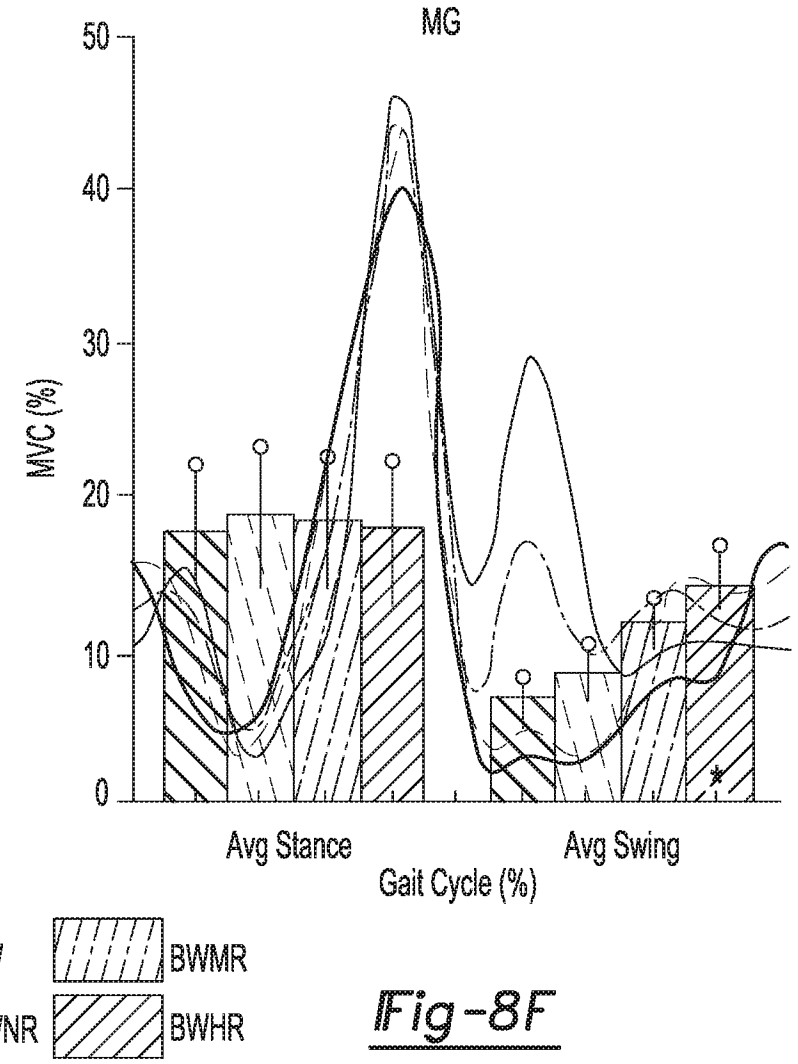
Figure 8E:
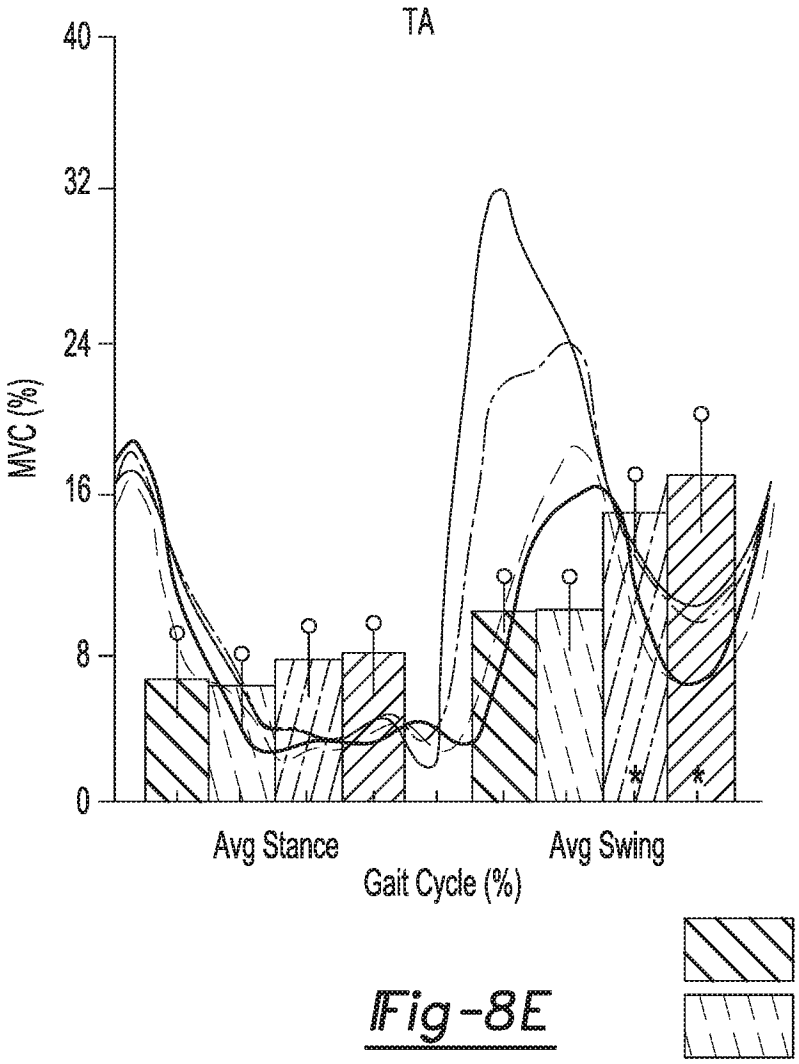
Figure 8H:
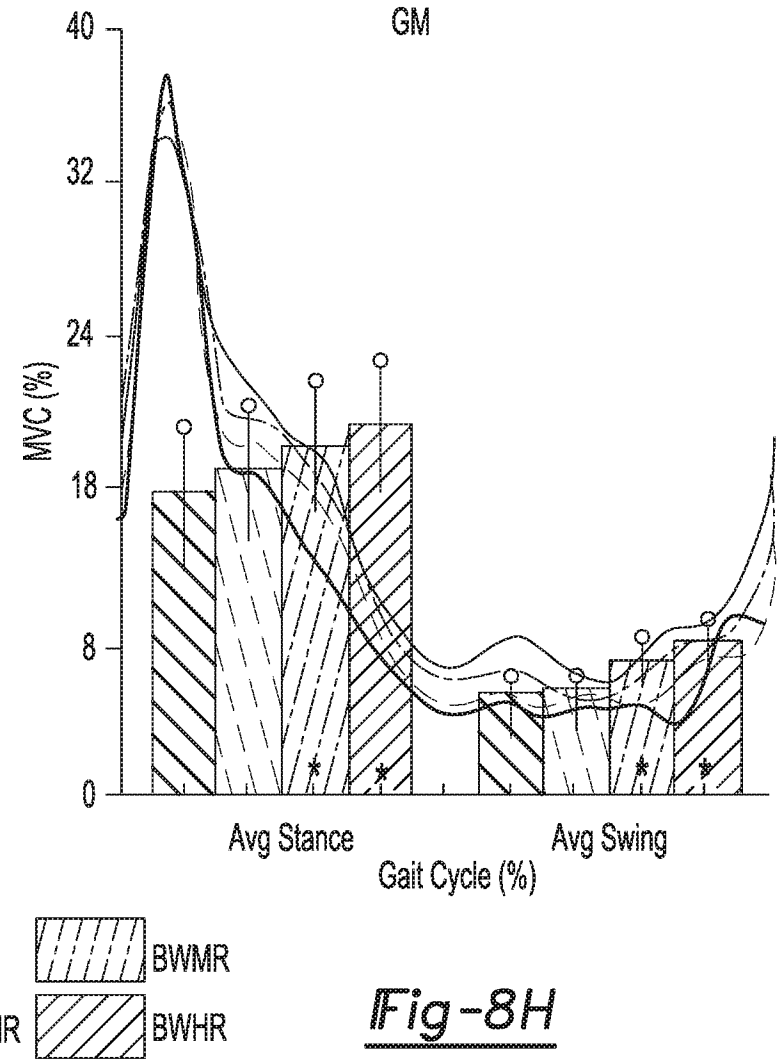
Figure 8G:
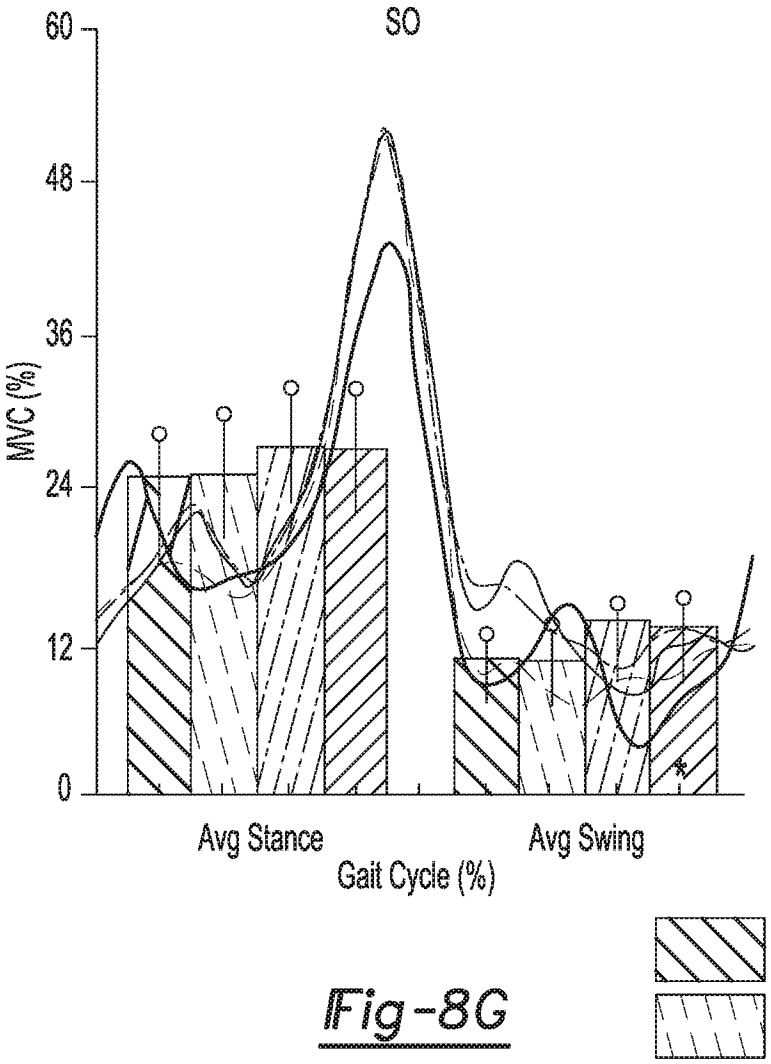

There was a significant main effect of trial on hip [F(3,18)=6.907; p=0.003] and knee joint excursions [F(3,18)=23.420; p<0.001] during resisted target matching (FIGS. 7C-7D). Post-hoc analysis showed that the hip joint excursions were greater during the target matching trials (FIG. 7D) (TMMR: 4.5±3.7°, p=0.003; TMHR: 4.5±3.1°, p=0.002), but the knee joint excursions were smaller (FIG. 7C) (TMLR: −7.8±5.1°, p=0.004; TMMR: −12.0±7.2°, p<0.001; TMHR: −16.4±4.9°, p<0.001) during the target matching trials when compared with baseline walking with no resistance.

Transparency of the Wearable Resistive Device 10 During Baseline Walking

The EMG profiles observed during baseline walking with no resistance were relatively similar to those observed during baseline walking without the wearable resistive device 10 (FIGS. 6A-6H). However, paired t-tests indicated small, but significantly greater activation of the rectus femoris (FIG. 6B) (0.96±1.03%; p=0.035) and soleus (FIG. 6G) (1.87±1.76%; p=0.030) muscles during the stance phase, and of the rectus femoris (FIG. 6B) (1.0±1.24%; p=0.038), tibialis anterior (FIG. 6E) (1.95±1.94%; p=0.017), and gastrocnemius (FIG. 6F) (1.83±3.64%; p=0.029) muscles during the swing phase of the gait. There were no differences in hip (FIG. 7B) (36.2±2.8° and 39.1±4.9°; p=0.15) or knee (FIG. 7C) (65.0±2.5° and 69.6±8.7°; p=0.08) joint excursions during baseline walking and baseline walking with no resistance trials.

Kinematic Aftereffects of Resisted Target Matching

A brief period of training with the wearable resistive device 10 resulted in significant increases in knee joint excursions during baseline walking with no device (4.2±2.6°; p=0.005) and baseline walking with no resistance trials (5.4±4.7°; p=0.023) (FIG. 9A). Training also resulted in a significant increase in hip joint excursion during the baseline walking with no resistance trial (2.6±1.6°; p=0.005); however, no differences were observed in the baseline walking trial (−0.1±1.4°; p=0.825) (FIG. 9B).

Discussion

The experimental results indicate that eddy current braking is a feasible option for this application, as our benchtop testing indicated that it can generate the torque required for functional strength training at a relatively small size and weight. Additionally, with the incorporation of a linear slider, we were able to obtain an adjustable resistance that can be regulated based on a subject's impairment level and functional capacity. The results from the human subjects experiment also indicated that the wearable resistive device 10 was largely transparent, as there were minimal alterations in hip/knee kinematics (3° to 5°) and lower extremity muscle activation (<2% MVC).

However, once the resistance was added, knee excursions reduced substantially. This was expected because the nervous system is known to optimize metabolic and movement related costs during walking or reaching movements. Interestingly, despite the reduction in knee joint excursions during resisted baseline walking, muscle activation still increased in some of the muscles.

More importantly, when subjects performed target tracking to minimize kinematic slacking (i.e., a phenomenon where the motor system reduces muscle activation levels and movement excursions to minimize metabolic and movement related costs) during resisted walking, the EMG activation increased several-fold in many of the muscles used in gait. Further, the aftereffects observed in hip and knee kinematics after a brief period of resisted target matching suggest that the wearable resistive device 10 may have meaningful clinical potential, albeit further research is required to verify this premise.

The eddy current braking device is unique because it can provide bidirectional resistance across the joint-. Accordingly, muscle activation during target matching in our human subject experiment scaled largest around the knee joint. Interestingly, we also found that providing a resistance across the knee elicited increased activity of muscles spanning the hip and the ankle joints.

These findings are consistent with previous studies and suggest that performing a motor learning task with the proposed device requires coordinated inputs from multiple muscles in the lower limb. The increased activation of the non-targeted muscles is potentially due to the synergistic and-or biarticular nature of some of the leg muscles (e.g. medial gastrocnemius), and recruitment of these muscles may have assisted in the process of overcoming the applied resistance.

The eddy current brake in this study produced large resistive forces when compared to other wearable devices. The estimated resistive torques during the target matching trials ranged between 10 to 45 N·m (FIG. 10), which are quite large considering the weight of the wearable resistive device 10. Also, changes in EMG activation were larger in comparison to those observed during walking with a 4 or 8 kg weight attached to the foot.

These results suggest that eddy current braking is a suitable alternative to loading the lower limb muscles during walking or other movements. However, it is important to note that subjects reduced their joint excursions during resisted walking. As a result, the changes in muscle activation were subtle during simple resisted walking (i.e., baseline resisted walking): with some muscles showing lower activation. Incorporating a target tracking task that provided feedback about their leg movements effectively minimized the kinematic slacking observed during resisted baseline walking. Further, muscle activation increased several-fold during target tracking trials.

These findings emphasize the importance of kinematic feedback during functional strength training, and failure to address kinematic slacking could reduce the effectiveness of functional strength training and promote compensatory movements. The kinematic feedback could also assist in minimizing off-plane motions (e.g., increased hip abduction/adduction) because the wearable resistive device 10 in itself does not constrain those movements. In our experience, the wearable resistive device 10-induced off-plane motions were minimal (<1°) in healthy subjects; however, certain patient populations (e.g., stroke) may behave differently due to abnormal synergistic coupling of motions across joints.

While testing the clinical benefits of this device was not the focus of this study, the proposed device may have value in physical rehabilitation. Past research indicates that an ideal rehabilitation device should (1) encourage activities specific to daily living, (2) be able to be taken home, (3) have adjustable resistance to meet client needs, (4) have the potential to provide biofeedback to the clients, and (5) cost under $6,000.

The present invention meets all these clinical guidelines. Additionally, functional strength training with this device is advantageous because it is not confined to treadmill training. Instead, training can take place over-ground, where the behavior is more specific to tasks encountered during daily living. Appropriate feedback can be administered during over-ground walking in the form of instructor/auditory feedback, obstacle training, or even kinematic tracking using inertial measurement units or encoders or other angle measuring devices on the device.

Given that the wearable resistive device 10 is lightweight and portable, it could also be taken home to greatly amplify the dosage of therapy outside the clinical setting or in remote areas where rehabilitative care is not readily available. The wearable resistive device 10 is also inherently safe because eddy current brakes are passive actuators that dissipate energy, as opposed to active motors that add energy to the system—with an active device, if there is a malfunction or error in the controls, unexpected motions could bring serious injuries to the user.

Further, the clinical relevance of the wearable resistive device 10 may extend outside of therapy for neurological injury. For example, because thigh muscle strength is critical for adequate lower limb function and quality of life, we believe that the wearable resistive device 10 could be beneficial for many subjects recovering from serious knee injuries, such as anterior cruciate ligament injury or repair, where thigh muscle strength deficits are profound.

There were many design challenges faced while creating the wearable resistive device 10. Eddy current braking is capable of providing large levels of resistance, but these are generally coupled with high inertias. This limits the transparency of the wearable resistive device 10, as the resistive torque is dependent on the thickness, radius, and angular velocity of the disc, all of which increase rotational inertia. For this reason, we used a cable capstan coupling in our initial prototypes, as it allowed for a compact design with zero backlash during torque transmission, which provided a smoother feel to the user.

However, the cable capstan was unable to withstand repeated wear. A planetary gearbox not only solved this issue, but also made the wearable resistive device 10 modular (i.e., the gear ratios can be changed if necessary). However, we found that the set screws were prone to back off the gear shaft during repetitive loading. Adding an additional key on the gearing shaft and a through pin to the rotating shaft resolved this issue and kept the interfaces rigid without slipping. Further, by making the protruding arms of the wearable resistive device 10 identical to those of the brace, the wearable resistive device 10 fit seamlessly into the commercial leg brace. This proved to be a better option than superposing the wearable resistive device 10 onto the brace, as it left the adjustability intact and reduced weight.

Further improvements are possible for better utilization of the wearable resistive device 10. The resistance setting of the device used for the experiment was manually controlled using a linear slider. We have incorporated extensions to the design to realize a computer-controlled resistance, with resistance programmed to be a function of time, gait kinematics, or muscle activations.

For example, a small motor in conjunction with microprocessor control was added to modulate the area of the magnet exposed on the aluminum disc. Besides keeping the wearable resistive device 10 passive (as the motors would not directly act on the subject's leg), it has also enabled us to modulate the resistance levels dynamically based on a subject's rehabilitation needs.

Moreover, bidirectional resistance may not be appropriate for all patient groups, such as those that have muscle imbalances across a joint. The addition of computer control or even a simple ratcheting mechanism, where the disc could be engaged and disengaged based on the direction of the movement, enables the wearable resistive device 10 to provide unidirectional resistance. This allows the wearable resistive device 10 to resist the weak agonist while not loading the stronger antagonist.

In summary, we fabricated a lightweight yet high torque eddy current brake and packaged it into a commercially available knee brace to create a wearable device that is capable of providing resistance across a joint for functional strength training. We also showed that the wearable resistive device 10 increased muscle activation in many of the key muscles used in gait. Further, we demonstrated that a brief period of training with the resistive device induced positive kinematic aftereffects in both the hip and knee joints.

These results demonstrate that the resistive device described in this study is a feasible and promising approach to actively engage and strengthen the key muscles used in gait.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A resistive device comprising:

a structure assembly having a first section and a second section, the first section being pivotally connected to the second section; and an eddy current braking system comprising:

an input shaft connected to the first section of the structure assembly for rotational movement therewith, a magnetic assembly having at least one magnet pair, a transmission system operably coupled to the input shaft receiving the rotational movement thereof and driving a driven shaft in response thereto, and a disk being operably coupled to the driven shaft for rotation therewith in response to movement of the driven shaft, the disk being positioned relative to the at least one magnet pair of the magnetic assembly to induce eddy currents therein whereby a resistive force is generated opposing movement of the first section of the structure assembly relative to the second section of the structure assembly in at least one direction.

2. The resistive device according to claim 1 further comprising:

a movement mechanism configured to move the magnetic assembly relative to the disk.

3. The resistive device according to claim 2 wherein the movement mechanism is a manually-adjustable mechanism.

4. The resistive device according to claim 2 wherein the movement mechanism is an actuator-controlled mechanism.

5. The resistive device according to claim 2 wherein the movement mechanism is a computer-controlled mechanism.

6. The resistive device according to claim 2 wherein the movement mechanism is a computer-controlled mechanism controlling resistance of the eddy current braking system.

7. The resistive device according to claim 2 wherein the movement mechanism is a computer-controlled mechanism, the computer-controlled mechanism being responsive to at least one sensor detecting an operational parameter.

8. The resistive device according to claim 1 wherein a resistance of the eddy current braking system is computer-controlled.

9. The resistive device according to claim 8, wherein the computer-controlled resistance of the eddy current braking system is responsive to at least one sensor detecting an operational parameter.

10. The resistive device according to claim 8 wherein the at least one magnet pair of the magnetic assembly comprises at least one electromagnet operable to output a variable magnetic force.

11. The resistive device according to claim 10 wherein the gear ratio is about 1:26.

12. The resistive device according to claim 1 wherein the input shaft of the eddy current braking system is coaxially aligned with an axis of the driven shaft.

13. The resistive device according to claim 1 wherein the at least one magnet of the magnetic assembly comprises at least one electromagnet operable to output a variable magnetic force.

14. The resistive device according to claim 1 wherein the transmission system comprises a gear ratio between the input shaft and the driven shaft.

15. The resistive device according to claim 1 wherein the transmission system comprises a clutch system that drives the driven shaft in a single rotational direction in response to bi-directional movement of the input shaft.

16. The resistive device according to claim 1 wherein the first section of the structure assembly is configured to be connected to a surface.

17. The resistive device according to claim 1 wherein the magnetic assembly is connected to the second section of the structure assembly for movement therewith.

* * * * *